US006017118A

United States Patent [19]

Gasvoda et al.

[11] Patent Number: 6,017,118

[45] Date of Patent: Jan. 25, 2000

[54] HIGH PERFORMANCE INK CONTAINER WITH EFFICIENT CONSTRUCTION

[75] Inventors: Eric L. Gasvoda, Salem; Susan M. Hmelar, Corvallis, both of Oreg.; Richard H. Lewis, Barcelona, Spain; Norman E. Pawlowski, Jr., Corvallis, Oreg.; Mark R. Hock, Toledo, Ohio; Dennis W. Houpt, Toledo, Ohio; David C. Kamp, Grand Rapids, Ohio; Thomas J. Krall, Toledo, Ohio; Jared E. Neff, Toledo, Ohio; William E. Fillmore, Toledo, Ohio; James Kenneth Wallace, Greenwood, Ind.

[73] Assignee: Hewlett-Packard Company, Palo Alto, Calif.

[21] Appl. No.: 08/869,023

[22] Filed: Jun. 4, 1997

Related U.S. Application Data

[63] Continuation-in-part of application No. 08/566,521, Dec. 4, 1995, abandoned, and application No. 08/429,915, Apr. 27, 1995, Pat. No. 5,825,387.

[51] Int. Cl.[7] ..... B41J 2/175

[52] U.S. Cl. ..... 347/86

[58] Field of Search ..... 347/50, 84, 85, 347/86, 30; 355/260; 346/75

[56] References Cited

U.S. PATENT DOCUMENTS

| | | | |
|---|---|---|---|
| 3,371,350 | 2/1968 | Sanderson et al. | 346/140.1 |
| 3,950,761 | 4/1976 | Kashio | 347/85 R |
| 4,183,031 | 1/1980 | Kyser et al. | 347/86 R |
| 4,422,084 | 12/1983 | Saito | 347/7 |
| 4,432,005 | 2/1984 | Duffield et al. | 347/86 |

(List continued on next page.)

FOREIGN PATENT DOCUMENTS

| | | | |
|---|---|---|---|
| 0623471 A2 | 11/1994 | European Pat. Off. | B41J 2/175 |
| 0726154A2 | 8/1996 | European Pat. Off. | B41J 2/175 |
| 0739740 A1 | 10/1996 | European Pat. Off. | B41J 2/175 |
| 0741038 A1 | 11/1996 | European Pat. Off. . | |
| 0778148 A1 | 6/1997 | European Pat. Off. | B41J 2/175 |
| 0808718 A2 | 11/1997 | European Pat. Off. | B41J 2/175 |
| WO 9605061 | 2/1996 | WIPO | B41J 2/175 |

OTHER PUBLICATIONS

PCT—International Search Report, Int. App. No: PCT/US 98/11444, mailed Oct. 8, 1998, Hewlett–Packard Company (5 pgs.).

Patent Abstracts of Japan, vol. 097, No. 005, Jan. 21, 1997 & JP 09020018 A, Brother Ind Ltd, Jan. 21, 1997.

*Primary Examiner*—N. Le
*Assistant Examiner*—Anh T. N. Vo

[57] ABSTRACT

An ink container for an inkjet printing system is described, including an assembly of a simple housing with caps bearing indicia and protective surfaces to enable effective handling, aligning, keying and latching of the ink container. The ink container includes an ink container housing, the housing including an ink reservoir and a fluid outlet in fluid communication with said reservoir. The fluid outlet is for providing ink to the inkjet printhead. The container further includes a separately fabricated first cap attached to an end of the housing, the first cap having a plurality of mechanical features that provide mechanical functions for the ink container. The end of the housing is a leading end relative to a direction of insertion of the ink container into the printing system. The mechanical functions can include positioning the ink container relative to the supply station, a keying function for preventing installation of an ink container in the supply station without a cap providing the keying function. The mechanical features can include a boss for protecting a leading surface of the ink container and the fluid outlet from physical damage. The trailing end of the housing has attached to it a second cap having a latch feature for latching the ink container in the supply station, and an oversized handle that prevents backwards insertion. The housing includes a pressure vessel that surrounds the ink reservoir, and the first cap is secured to the pressure vessel.

39 Claims, 20 Drawing Sheets

U.S. PATENT DOCUMENTS

| | | | |
|---|---|---|---|
| 4,558,326 | 12/1985 | Kimura et al. | 347/30 |
| 4,568,954 | 2/1986 | Rosback | 347/86 |
| 4,604,633 | 8/1986 | Kimura et al. | 347/7 |
| 4,714,937 | 12/1987 | Kaplinsky | 347/86 |
| 4,853,708 | 8/1989 | Walters | 346/75 |
| 4,977,413 | 12/1990 | Yamanaka et al. | 347/7 |
| 5,408,256 | 4/1995 | Keen et al. | 347/87 |
| 5,530,531 | 6/1996 | Girard | 355/260 |
| 5,734,401 | 3/1998 | Clark et al. | 347/86 |

PRINTER CONTROLLER: FIRMWARE MICROPROCESSOR
80
PRINTER DRIVER
CPU
MONITOR
82B
82
82A
84
100
116
INK SUPPLY STATION
114
112
50
52
66
64
62
60
110
110A
110B
SCANNING CARRIAGE
MEDIA
40
70
AIR PRESSURE SOURCE

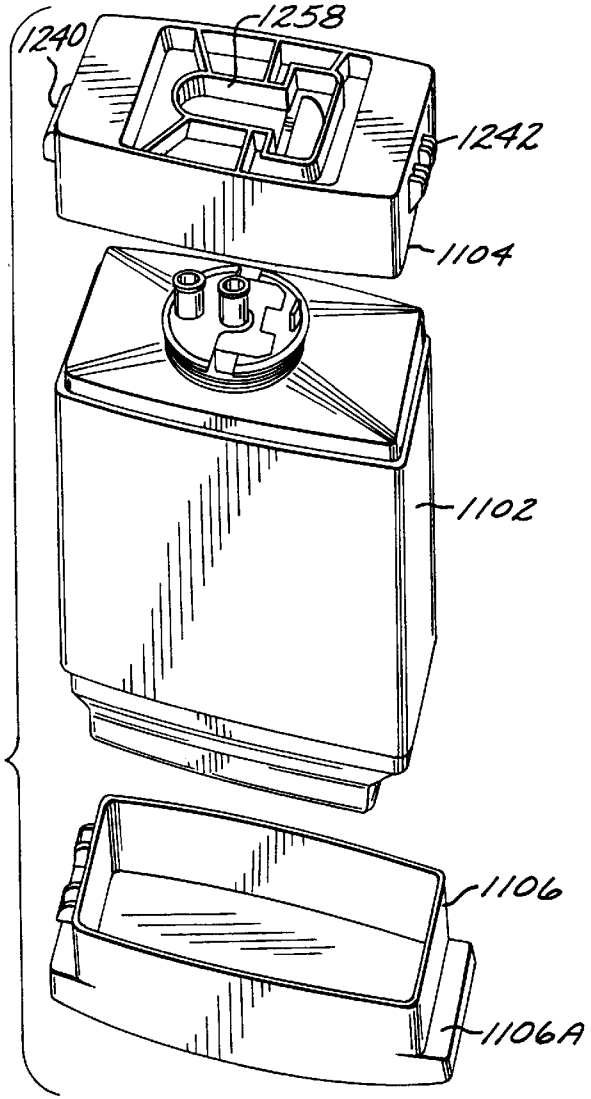
FIG. 5A
FIG. 5B
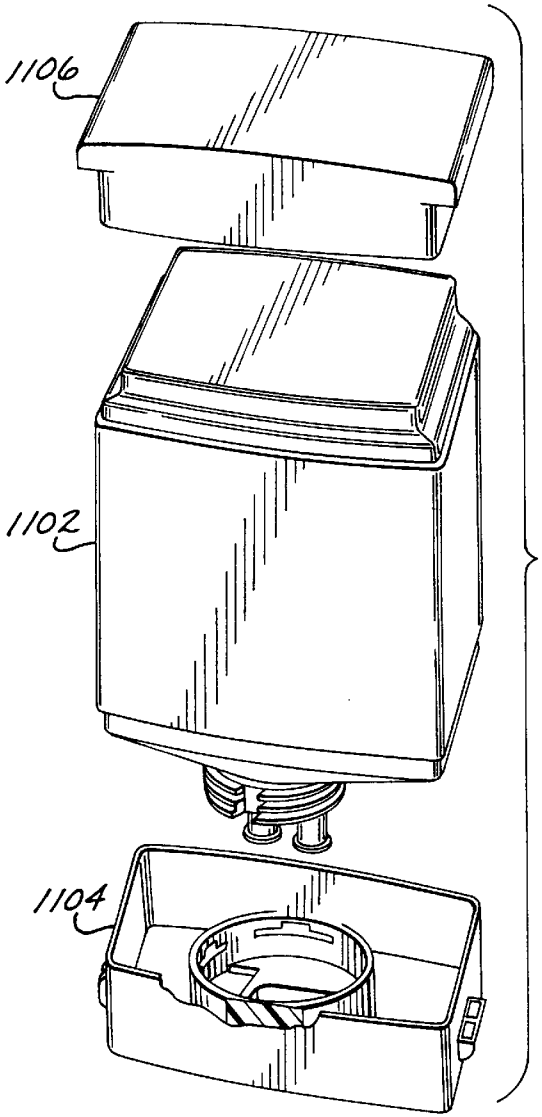

1110
1202
1160
1162
1280
1252A
1158
1152
1156
1252B
1150
1148
1120
1252C
1102
1154
1144
1122
1124
1142
1126
1130
1114
1116
1132
13
1134
1136
1112
13
114
1118

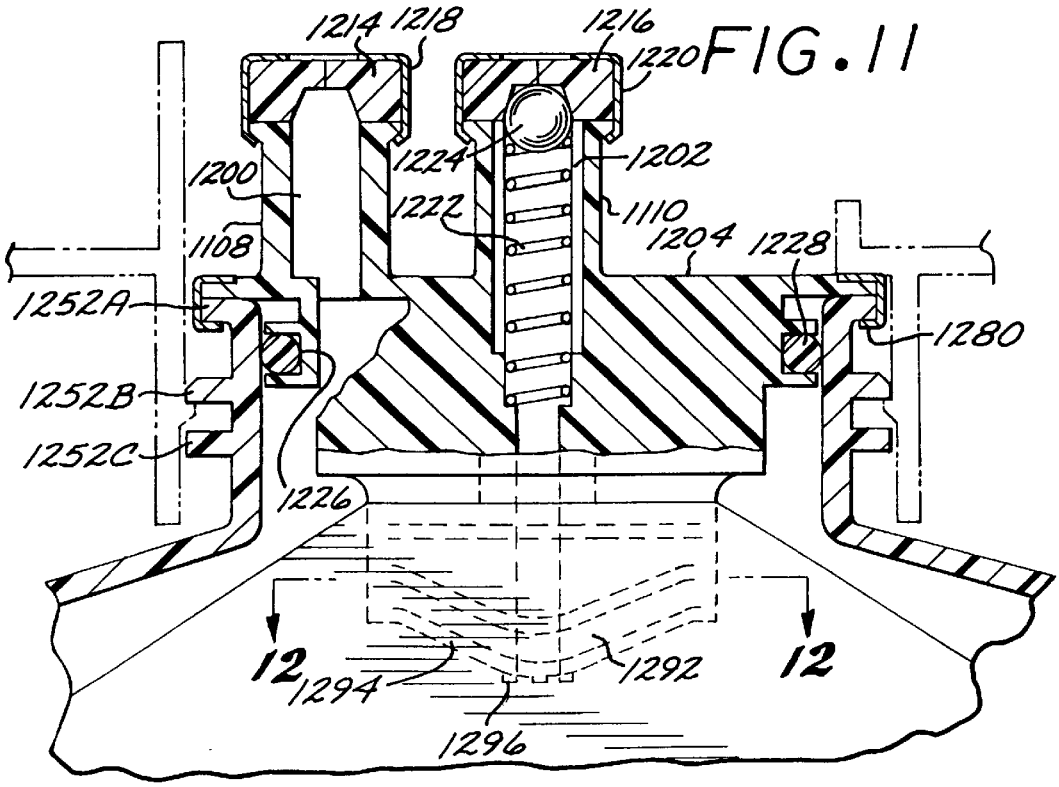
FIG. 11
FIG. 12
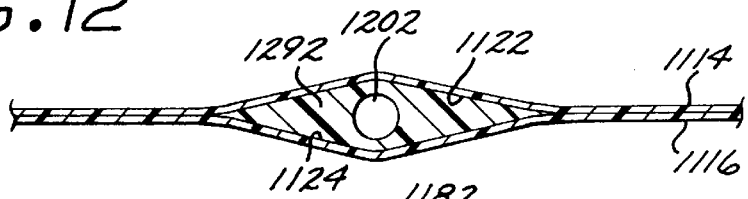
FIG. 13
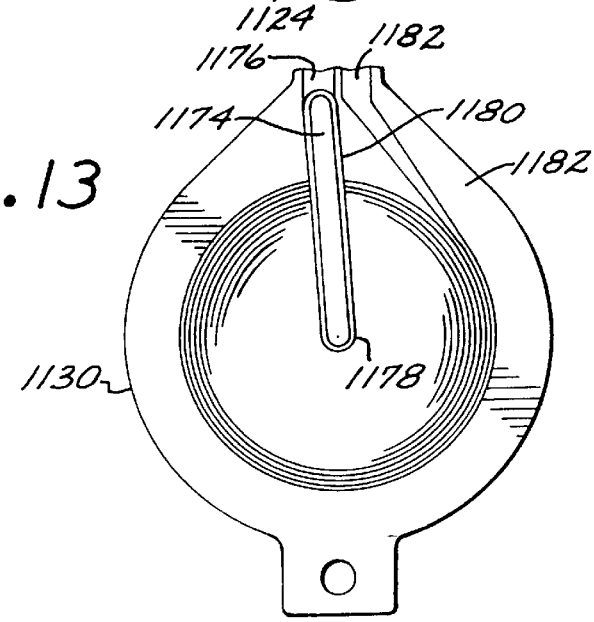

HIGH PERFORMANCE INK CONTAINER WITH EFFICIENT CONSTRUCTION

This is a continuation-in-part of U.S. Ser. No. 08/566,521, filed Dec. 4, 1995, entitled KEYING SYSTEM FOR INK SUPPLY CONTAINERS, and of U.S. Ser. No. 08/429,915, filed Apr. 27, 1995, now U.S. Pat. No. 5,825,387 entitled INK SUPPLY FOR AN INKJET PRINTER, each application incorporated herein by this reference.

CROSS-REFERENCE TO RELATED APPLICATIONS

This application is related to the following copending patent applications, each of which is incorporated herein by this reference: U.S. Ser. No. 08/869,038, filed Jun. 4, 1997, entitled ELECTRICAL INTERCONNECT FOR AN INK CONTAINER, filed herewith; U.S. Ser. No. 08/869,150, filed Jun. 04, 1997, entitled METHOD AND APPARATUS FOR SECURING AN INK CONTAINER, filed herewith; U.S. Ser. No. 08/871,566, Jun. 4, 1997, entitled REPLACEABLE INK CONTAINER ADAPTED TO FORM RELIABLE FLUID, AIR AND ELECTRICAL CONNECTION TO A PRINTING SYSTEM, filed herewith; U.S. Ser. No. 08/869,240, filed Jun. 4, 1997, entitled INK CONTAINER WITH AN INDUCTIVE INK LEVEL SENSE, filed herewith; U.S. Ser. No. 08/869,122, filed Jun. 4, 1997, entitled INK LEVEL ESTIMATION USING DROP COUNT AND INK LEVEL SENSE, filed herewith; U.S. Ser. No. 08/868,773, filed Jun. 4, 1997, entitled INK CONTAINER PROVIDING PRESSURIZED INK WITH INK LEVEL SENSOR; U.S. Ser. No. 08/868,927, filed Jun. 4, 1997, entitled AN INK CONTAINER HAVING A MULTIPLE FUNCTION CHASSIS, filed herewith.

TECHNICAL FIELD OF THE INVENTION

The present invention concerns replaceable ink supply containers for providing ink to a high flow rate ink delivery system.

BACKGROUND OF THE INVENTION

High throughput printing systems, such as those used in high speed printers and color copiers, or large format devices put heavy demand on an ink delivery system. The printhead must operate at a very high frequency. At the same time, print quality expectations keep rising. In order to maintain high print quality, the printhead must be able to rapidly eject ink without causing large fluctuations in the printhead pressure level.

One approach to this is to provide a pressure regulator integral to the printhead. The regulator receives ink at a first pressure and delivers ink to the printhead at a controlled second pressure. In order for this control to work, the first pressure must always be greater than the second pressure. Because of dynamic pressure drops, very high pixel rate printing requires that the first pressure be at a positive gauge pressure.

One example of an ink cartridge that can be pressurized is described in U.S. Pat. No. 4,568,954. Other references include U.S. Pat. Nos. 4,558,326; 4,604,633; 4,714,937; 4,977,413; Saito U.S. Pat. Nos. 4,422,084; and 4,342,041.

A simple way to provide pressure is to surround a collapsible bag with a pressurizable shell. In theory, such a shell can be simple in construction. However, the ink container exterior should perform a number of functions. It must provide keying, aligning and latching functions to provide the mechanical interface to the product. It should protect certain ink container features that are easily broken or contaminated. It should provide user-friendly grasping surfaces. When these requirements are integrated with the pressure chamber requirements, the outside of the ink container becomes very difficult to design and manufacture. What is needed is a way of offering the functionality just described while providing for efficient molding and assembly.

SUMMARY OF THE INVENTION

An ink container for an inkjet printing system is described, including in a preferred form an assembly of a simple housing with caps bearing indicia and protective surfaces to enable effective handling, aligning, keying and latching of the ink container. The ink container in an exemplary application is for an inkjet printing system, the printing system including a traversing carriage including at least one printhead, and an ink supply station into which the ink container is removably attached. The ink container includes an ink container housing, the housing including an ink reservoir and a fluid outlet in fluid communication with said reservoir. The fluid outlet is for providing ink to the printhead. The container further includes a separately fabricated first cap attached to an end of the housing, the first cap having a plurality of mechanical features that provide mechanical functions for the ink container.

In accordance with another aspect of the invention, the end of the housing is a leading end relative to a direction of insertion of the ink container into the printing system. The mechanical functions can include positioning the ink container relative to the supply station, a keying function for preventing installation of an ink container in the supply station without a cap providing the keying function. The mechanical features can include a boss for protecting a leading surface of the ink container and the fluid outlet from physical damage.

In accordance with a further aspect of the invention, the end of the housing is a trailing end relative to a direction of insertion of the ink container into the printing system. The mechanical features can include at least one latch feature for latching the ink container in the supply station, and an oversized handle that prevents backwards insertion.

The housing includes a pressure vessel that surrounds the ink reservoir, and the first cap is secured to the pressure vessel.

In accordance with yet another aspect of the invention, a method is described for efficiently assembling an ink container, comprising a sequence of the following steps:

- providing a chassis member having a keel and an ink tower and a circumferential surface, the chassis member providing an ink path from the keel on a first side of the chassis member to an ink tower on a second side of the chassis member;
- providing an ink reservoir bag having an open end;
- assembling the bag to the chassis member by securing the open end to surfaces of the keel to provide a leak-resistant joint between the keel surfaces and the bag;
- positioning a compressible seal member around the circumferential surface;
- providing a pressure vessel having an opening at a leading end of the pressure vessel;
- inserting the bag and chassis member assembly into the pressure vessel through the opening such that the bag is fully inserted into the interior of the pressure vessel, and the chassis member is inserted into the opening with the ink tower extending therefrom; and attaching a leading end cap to the leading end of the pressure vessel, the leading end cap including a protective wall structure surrounding the ink tower while permitting interconnection access to the ink tower.

BRIEF DESCRIPTION OF THE DRAWING

These and other features and advantages of the present invention will become more apparent from the following detailed description of an exemplary embodiment thereof, as illustrated in the accompanying drawings, in which:

FIG. 5A is a bottom isometric view of an ink container in accordance with the invention.

FIG. 5B is a top isometric view of the ink container of FIG. 5A.

FIG. 11 is a cross-sectional view of the off-carriage ink container, taken along line 11—11 of FIG. 9.

FIG. 12 is a cross-sectional view of the chassis structure, taken along line 12—12 of FIG. 11.

FIG. 13 is a top view of a ink level sensing coil attached to the ink reservoir bag comprising the off-carriage container, in the area shown by line 13—13 of FIG. 10.

DETAILED DESCRIPTION OF THE PREFERRED EMBODIMENT

Overview of the System.

Figure 1:
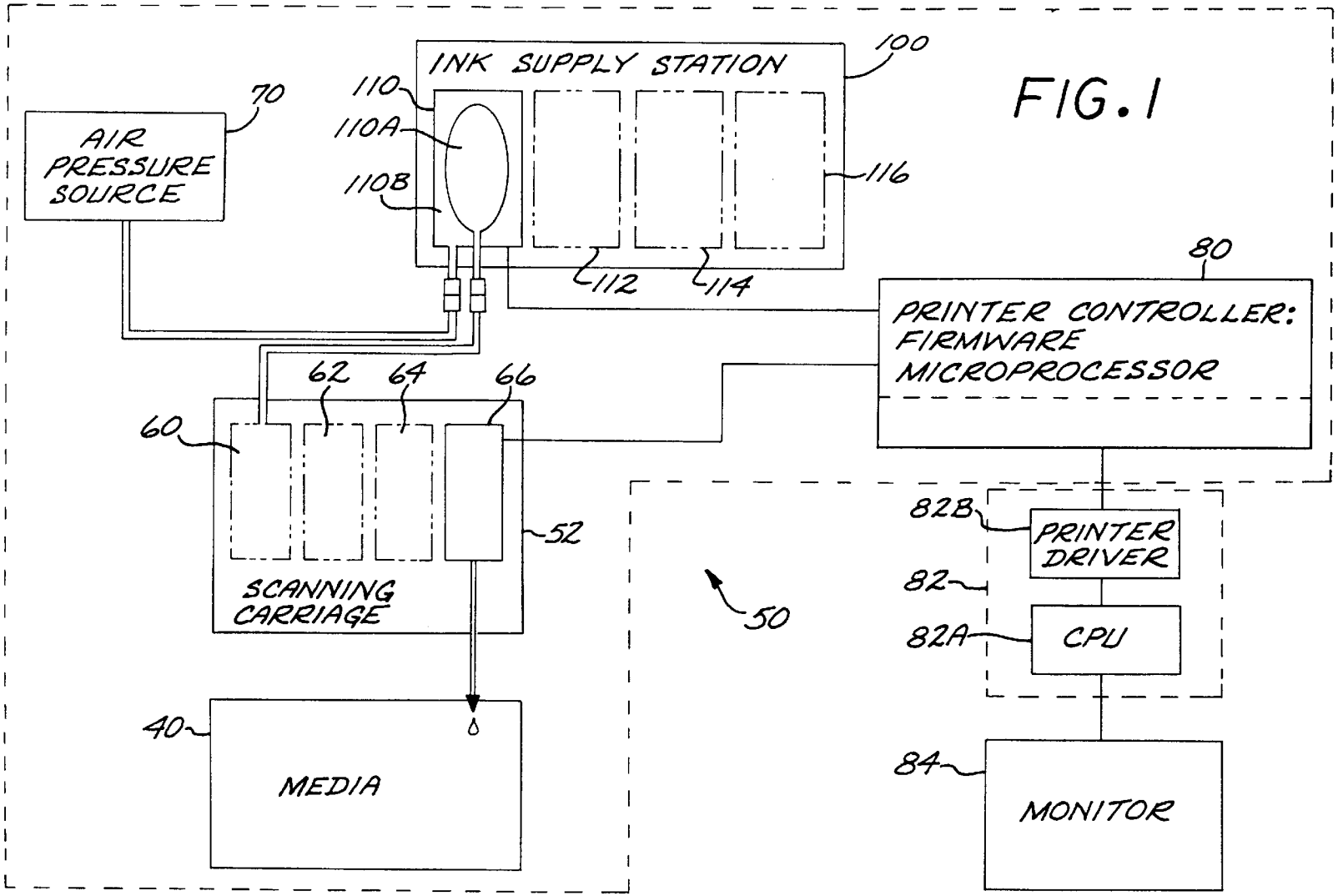
FIG. 1 is a schematic block diagram of a printer/plotter system in accordance with the invention.

FIG. 1 shows an overall block diagram of a printer/-plotter system 50 embodying the invention. A scanning carriage 52 holds a plurality of high performance print cartridges 60–66 that are fluidically coupled to an ink supply station 100. The supply station provides pressurized ink to the print cartridges. Each cartridge has a regulator valve that opens and closes to maintain a slight negative gauge pressure in the cartridge that is optimal for printhead performance. The ink being received is pressurized to eliminate effects of dynamic pressure drops.

The ink supply station 100 contains receptacles or bays for slidable mounting ink containers 110–116. Each ink container has a collapsible ink reservoir, such as reservoir 110A that is surrounded by an air pressure chamber 110B. An air pressure source or pump 70 is in communication with the air pressure chamber for pressurizing the collapsible reservoir. Pressurized ink is then delivered to the print cartridge, e.g. cartridge 66, by an ink flow path. One air pump supplies pressurized air for all ink containers in the system. In an exemplary embodiment, the pump supplies a positive pressure of 2 psi, in order to meet ink flow rates on the order of 25 cc/min. Of course, for systems having lower ink flow rate requirement, a lower pressure will suffice, and some cases with low throughput rates will require no positive air pressure at all.

Figure 2:
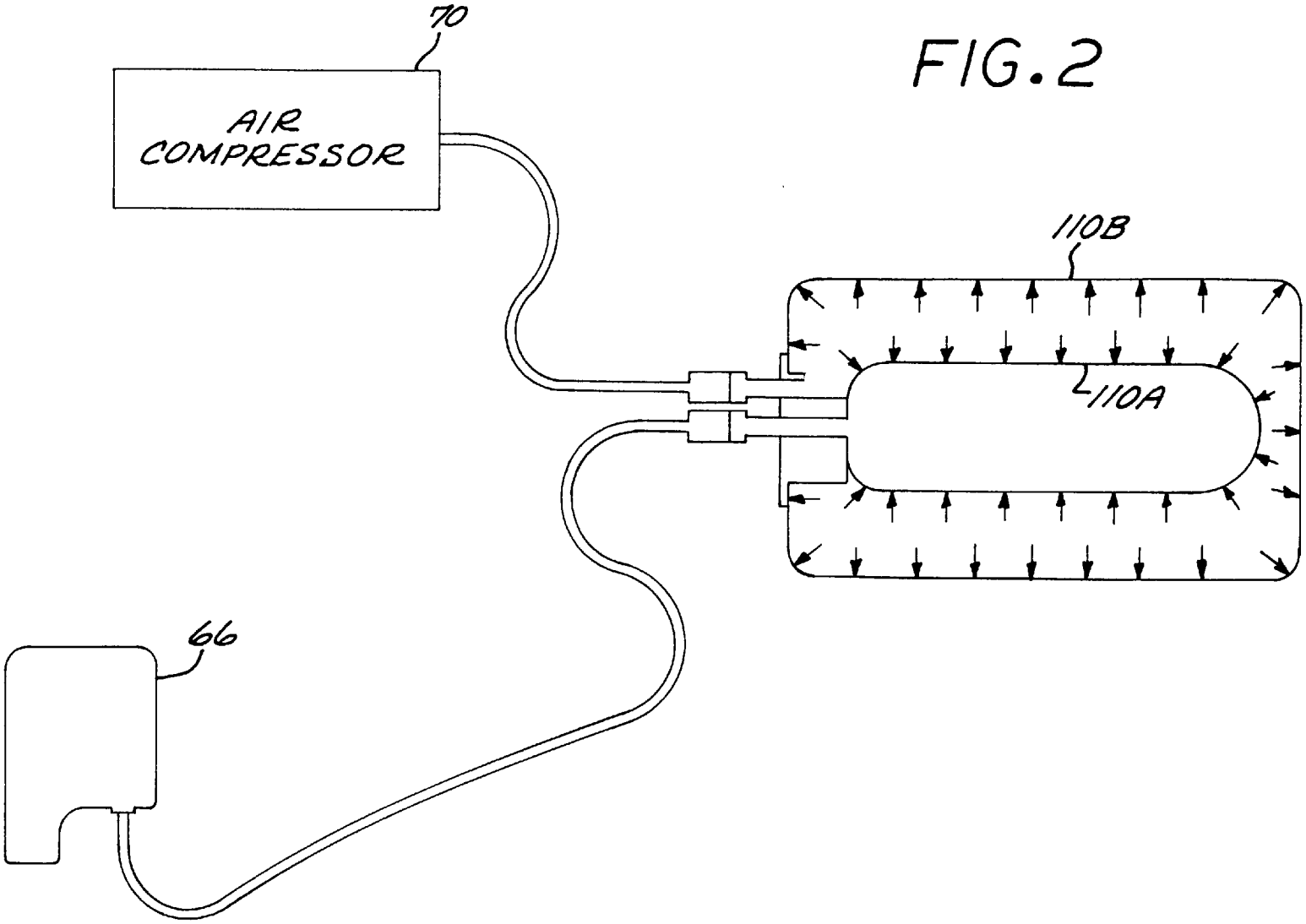
FIG. 2 is schematic block diagram illustrating in a simplified fashion an exemplary off-carriage ink container, with connection to an on-carriage print cartridge, and an air compressor for pressuring the off-carriage pressure vessel comprising the off-carriage ink container.

FIG. 2 is a simplified diagrammatic view illustrating the pressure source 70, the cartridge 66, and the reservoir 110A and pressure chamber 110B. During idle periods, the region between the reservoir bag and the pressure vessel is allowed to de-pressurize. During shipping of the ink container 110A, the supply is not pressurized.

The scanning carriage 52 and print cartridges 60–66 are controlled by the printer controller 80, which includes the printer firmware and microprocessor. The controller 80 thus controls the scanning carriage drive system and the print heads on the print cartridge to selectively energize the print heads, to cause ink droplets to be ejected in a controlled fashion onto the print medium 40.

The system 50 typically receives printing jobs and commands from a computer work station or personal computer 82, which includes a CPU 82A and a printer driver 82B for interfacing to the printing system 50. The work station further includes a monitor 84.

Figure 3:
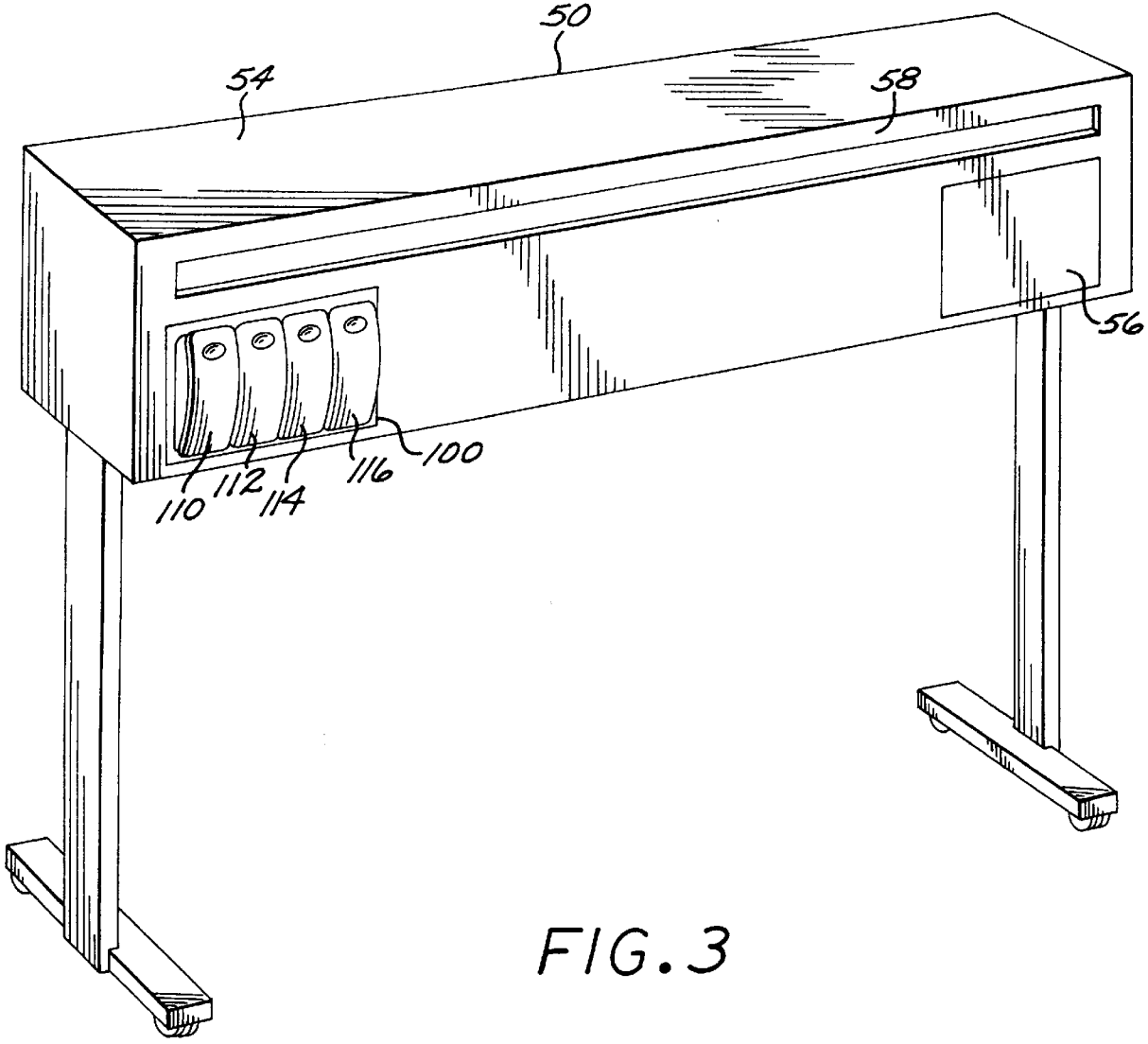
FIG. 3 is a simplified isometric view of a printer/plotter employing the present invention.

FIG. 3 shows in isometric view an exemplary form of a large scale format printer/plotter system 50, wherein four off-carriage ink containers 110, 112, 114, 116 are shown in place in the ink supply station. The system includes a housing 54, a front control panel 56 which provides user control switches, and a media output slot 58 through which the media is output from the system after the printing operation. This exemplary system is fed from a media roll; alternatively sheet fed systems can also be used.

Overview of the Invention

Figure 4:
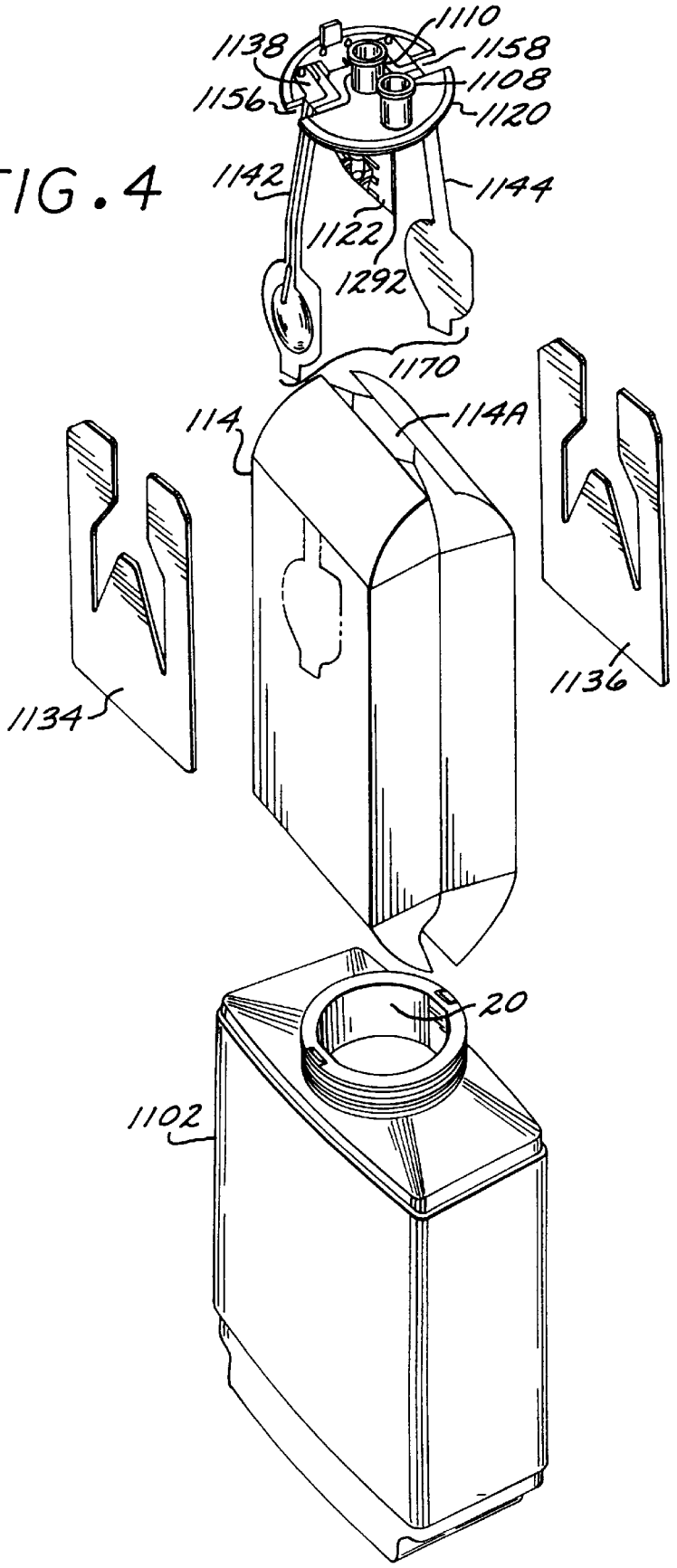
FIG. 4 is an exploded isometric view of the off-carriage ink container.

Aspects of the invention are illustrated in a general sense in the simplified diagrammatic views of FIGS. 4, 5A and 5B. One aspect of this invention concerns an ink container employed at the ink supply station 100, having a pressure vessel 1102 surrounding a collapsible reservoir 114 containing a supply of ink and a sensor circuit 1170 that can provides a signal indicative of the volume of the ink in the collapsible reservoir. Leads 1142, 1144 for connecting to the sensor circuitry are electrically accessible at contacts (indicated generally as 1138 in FIG. 4) on the outside of the container. To achieve this, the leads are routed from the contacts on the outside and to the sensor circuitry on the inside of the pressure vessel. The leads pass through a sealing zone 20 separating an outside atmosphere from the pressurized region between the pressure vessel and the collapsible reservoir. Advantages of the system include directly sensing the bag position, which is more accurate than other methods such as measuring ink resistivity, that depends on ink properties. Moreover, the sensor is out of contact with the ink; thus, it will not be corroded by ink. In a preferred embodiment, the sealing zone is provided by a resilient member under compression and acting as a gasket. This preferred embodiment has manufacturing and reliability advantages.

As shown in FIG. 4, a second aspect of the invention involves a chassis 1120 that offers functional and manufacturing advantages for the ink container. Ink container 110 has leading and trailing ends relative to a direction of installation of ink container 110 into supply station 100. The chassis includes a tower shaped air inlet 1108 for receiving pressurized air from a printing system and a tower shaped ink outlet 1110 for delivering pressurized ink to the system. The air inlet and ink outlet, accessible on the leading edge of the container 110, extend approximately equal distances beyond an exterior surface of the ink container 110. The ink outlet is in fluid communication with collapsible reservoir 114. In a preferred embodiment, the chassis includes an attach surface 1122 to be received in an opening 114A of the collapsible reservoir. This attach surface allows a volumetrically efficient pleated bag construction to be used for collapsible reservoir 114, by providing a surface whose normal is substantially parallel to the long axis of the bag. The chassis, in combination with a separate housing 1102, provides a pressure vessel that surrounds the collapsible reservoir 114. In an exemplary form, the housing 1102 is a bottle shaped structure with an opening for receiving a peripheral surface of the chassis. The chassis provides a surface for container electrical contacts associated with the printing system. The chassis provides a surface for routing an electrical pathway such as pathways 1156, 1158 between the sensor and some of the container electrical contacts 1138. In a preferred embodiment, the chassis provides all of this functionality with a single integral part. Using an integral part improves manufacturability and relative locational accuracy of the parts included in the chassis.

As shown in FIGS. 5A and 5B, a third aspect of the invention concerns at least one separately attached cap that provides mechanical functions. In a preferred embodiment, two caps 1104, 1106 are separately attached to the pressure vessel 1102. With this preferred embodiment, the mechanical functions include, for a trailing end cap, (i) latch features 1232 for securing the ink container 110 into supply station 100, and (ii) an oversized end 1106A that prevents backwards insertion of the ink container into the supply station. For a leading end cap, the mechanical functions include (i) a boss 1258 for protecting the container interconnects, (ii) keying features to assure that the ink container 110 is installed in the proper ink supply station location, and (iii) aligning features to assure proper positioning of the ink container into the supply station. By providing all of these functions on one or more end caps, the pressure vessel configuration can be simplified, and designed without any of the foregoing mechanical functional requirements.

A Preferred Embodiment of the Ink Container

An exemplary embodiment of the ink containers 110–116 is now described with reference to FIGS. 6–28; only one container need be described, since all the containers are identical, except for keying features on a cap described below. In general, the container is an assembly of a pressure vessel defining a pressure chamber, a collapsible ink reservoir including a flaccid bag, an ink level sensing (ILS) circuit, a multi-function chassis element to which the bag is sealed, the chassis providing an ink pathway from an outlet port to the reservoir and an air inlet port and pathway leading to a region of the pressure chamber outside the reservoir, and leading end and trailing end caps.

The Pressure Vessel. In an exemplary embodiment, the pressure vessel 1102 is a bottle-shaped structure having a neck region through which an opening extends to the interior of the vessel. One suitable method for fabricating the vessel at low cost is a combined blow-molding and injection molding process, wherein relatively higher tolerances are obtained for interior peripheral surfaces at the neck region of the vessel, and relatively low tolerances for the remainder of the vessel. An exemplary material suitable for the vessel in high-volume applications is polyethylene, injection-blow-molding grade; a typical thickness of the material for the vessel is 2 mm.

Figure 8:
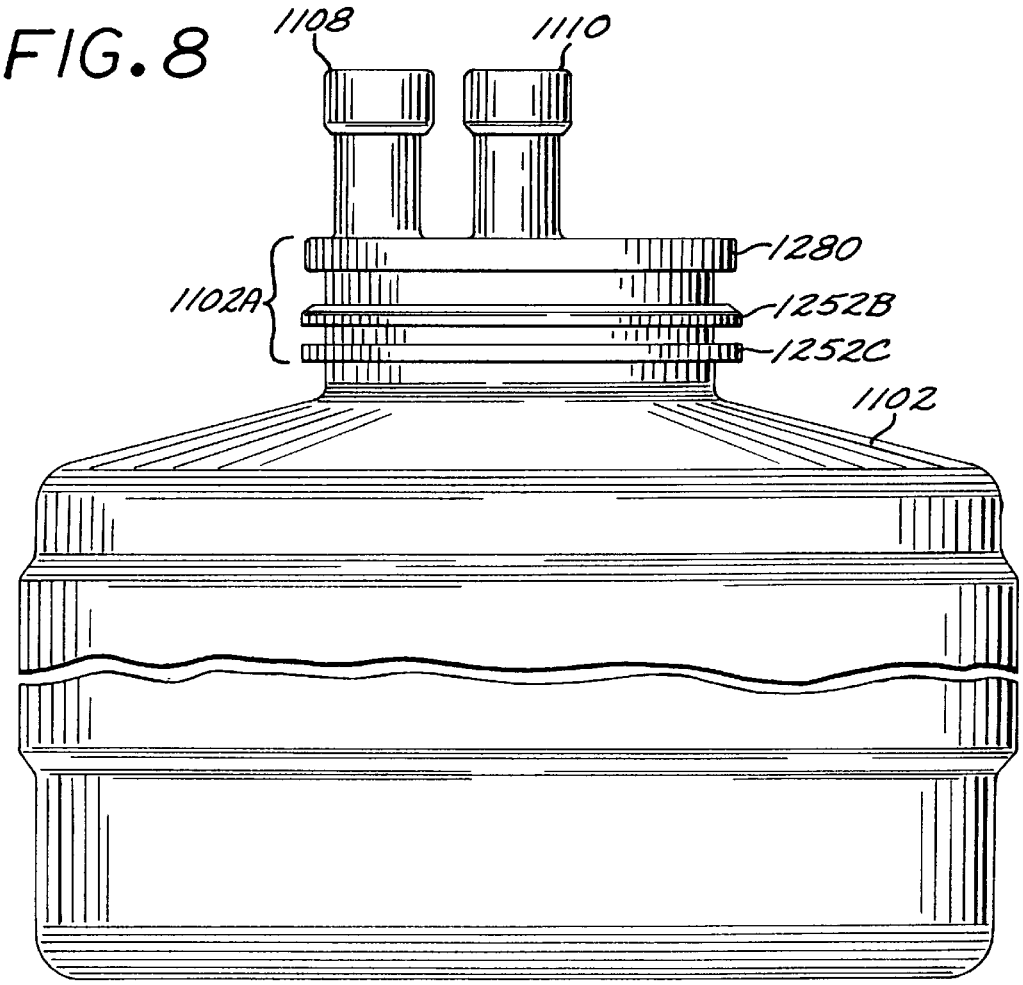
FIG. 8 is a partial front view of the chassis structure comprising the off-axis ink container.

The pressure vessel 1102 is shown in the broken side view of FIG. 8, with the air tower 1108 and ink tower 1110 which are defined by a chassis member, secured in place by a crimp ring 1280, as will be discussed below. Here, the neck region 1102A of the vessel appears, defining an inner peripheral neck surface of the pressure vessel.

The exterior of the neck region includes physical features for securing the internal ink container within the pressure vessel, and for securing a leading end cap. These features include a plurality of flanges (1252A–1252C) formed in the external surface of the neck region.

The volume of the interior pressure chamber of the vessel will be dependent on the desired ink capacity of the ink container. Products of different ink capacity can be provided by use of pressure vessels having a similar cross-sectional configuration, but with different vessel lengths in a direction along the longitudinal axis of the container, and with corresponding differences in the size of the ink reservoir bag. In an exemplary application, the vessel profile is 50 mm by 100 mm, with the vessel length a function of the container supply capacity. Exemplary ink capacities for different products are 350 cc and 750 cc. Inks of different colors and ink types can be stored in the ink containers, for use in the color printing systems as shown in FIG. 1. The vessel structure need not change to accommodate different ink colors or types. During manufacture, inventory and mold costs are managed by employing the same pressure vessel for the various ink types and colors.

While the pressure vessel 1102 illustrated in the drawings has a rectangular cross-section, it is to be understood that other vessel configurations can also be employed, such as cylindrical.

Figure 10:
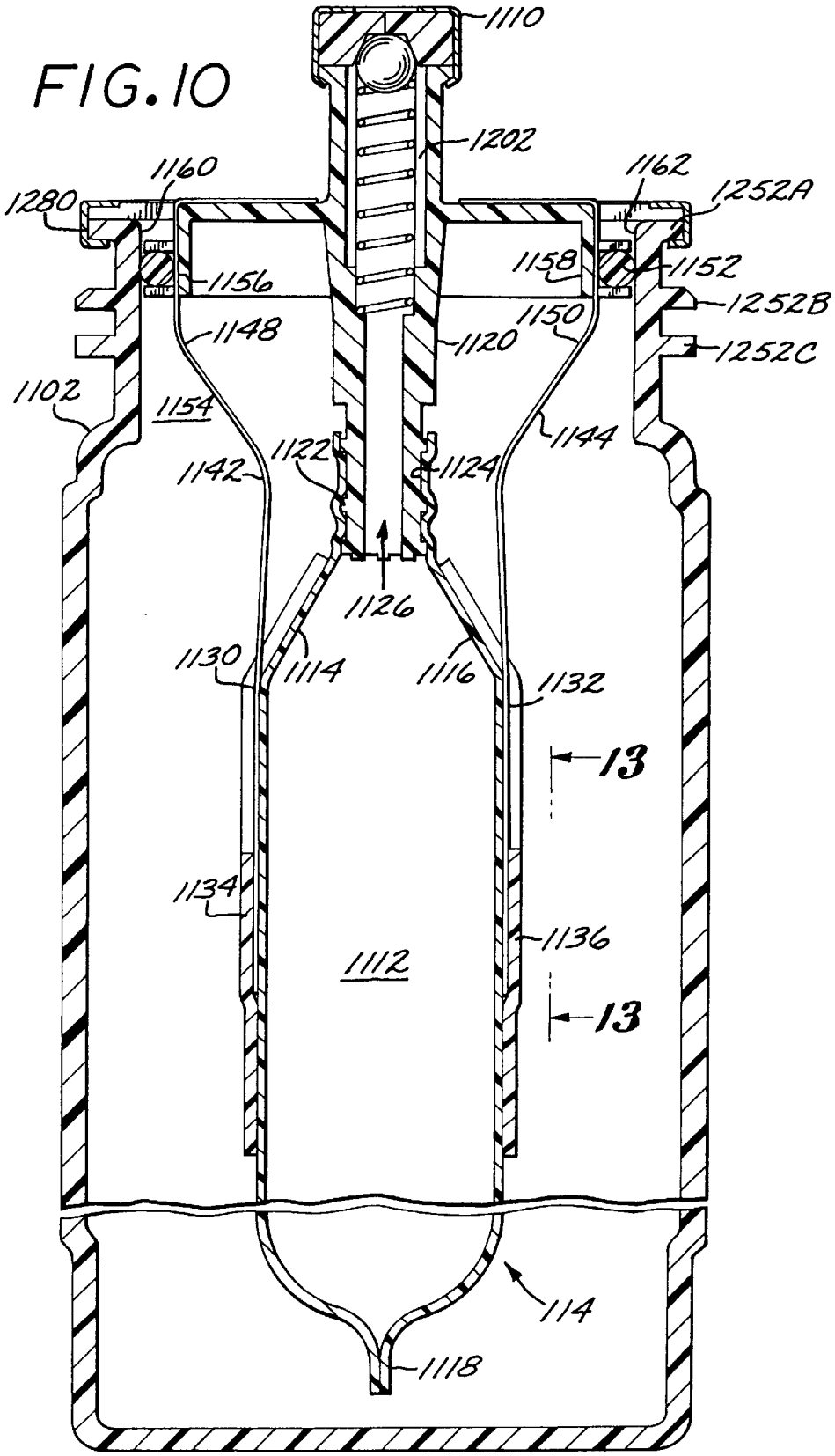
FIG. 10 is a cross-sectional view of the off-carriage ink container, taken along line 10—10 of FIG. 7.

The Ink Reservoir. The ink reservoir for the ink container in this embodiment is provided by a flaccid bag, which in an ink-filled state substantially occupies the open volume within the pressure vessel. FIG. 10 illustrates the collapsible liquid ink reservoir 114 surrounded by the pressure vessel 1102. In one implementation, an elongated sheet of the bag material is folded such that opposed lateral edges of the sheet overlap or are brought together, forming an elongated cylinder. These lateral edges are sealed together. Pleats are formed in this resulting structure, and the bottom of the reservoir bag is formed by heat sealing the pleated cylinder along a seam transverse to the seal of the lateral edges. The top of the reservoir bag is formed in a similar fashion, while leaving an opening for the bag to be sealed to the chassis member. In an exemplary embodiment, the bag material is a multilayered sheet, fabricated of polyethylene, metalized polyester and nylon. Rigid bag stiffener elements 1134, 1136 are attached respectively to the outside of the flexible bag of the reservoir, i.e. on opposite wall side portions 1114, 1116 of the reservoir. The stiffeners improve the repeatability of collapse geometry of the sides of the bag so that the ink level sensing signal provided by the ink level sensor has improved repeatability.

Ink Level Sensing Circuit. The ink level sensing circuit includes inductive coils 1130 and 1132 formed on flexible circuit substrate portions disposed on the opposing side wall portions of the reservoir bag. An AC signal is passed through one coil, inducing a voltage in the other coil whose magnitude varies as the wall separation distance varies. As ink is used, the opposing side wall portions 1114, 1116 collapse together, changing the electrical or electromagnetic coupling, e.g. mutual inductance, of the coil pair. This change in coupling is sensed by the printing system, which thereby infers an ink level.

Figure 6:
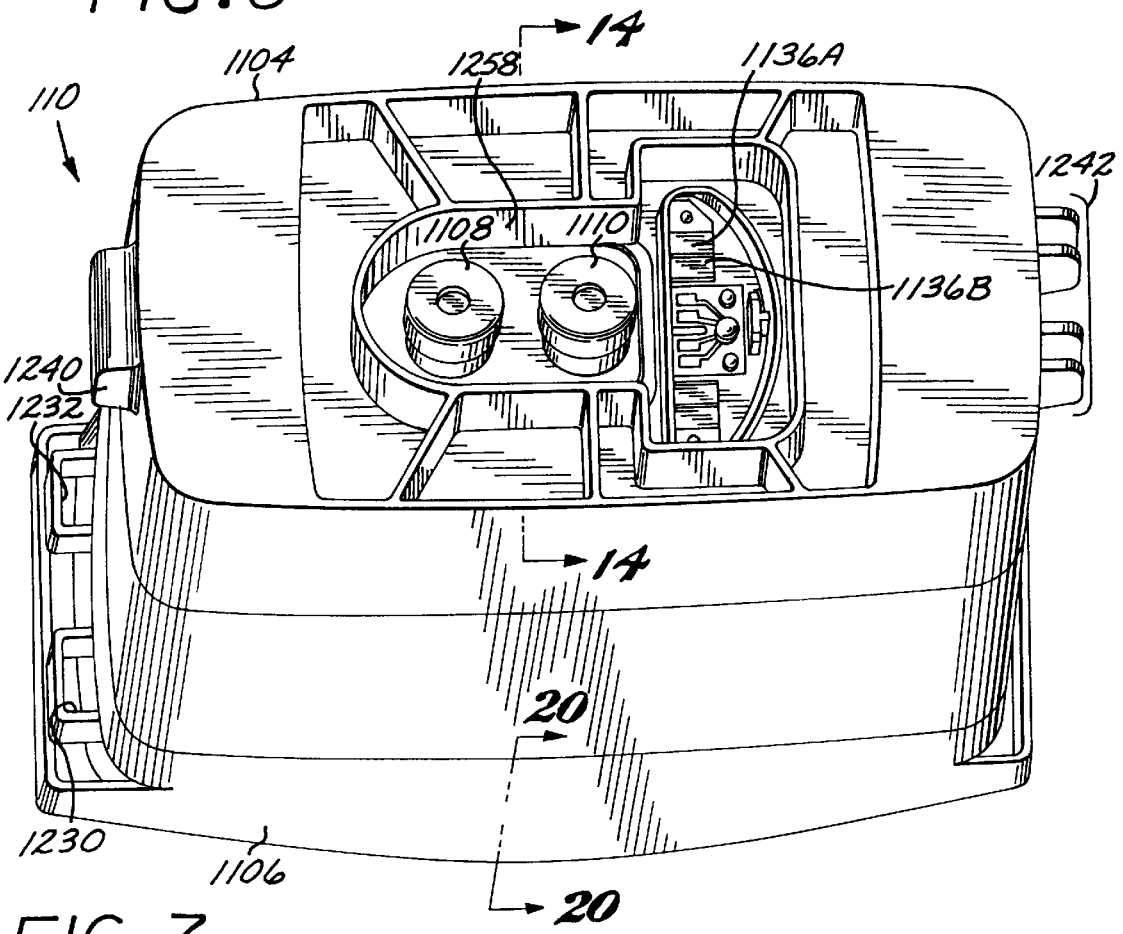
FIG. 6 is a view of the top of the off-carriage ink container.
Figure 7:
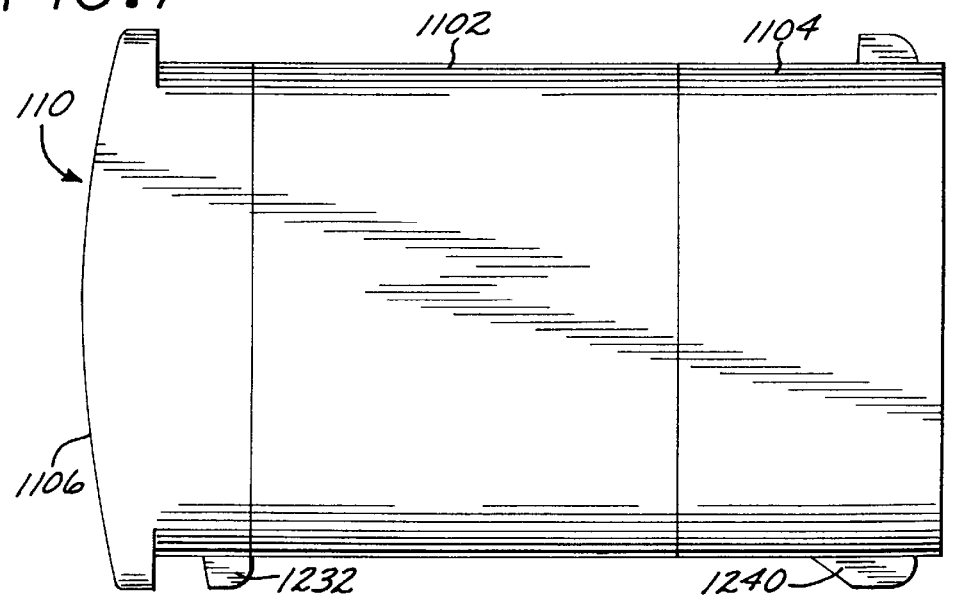
FIG. 7 is a side view of the off-carriage ink container.
Figure 9:
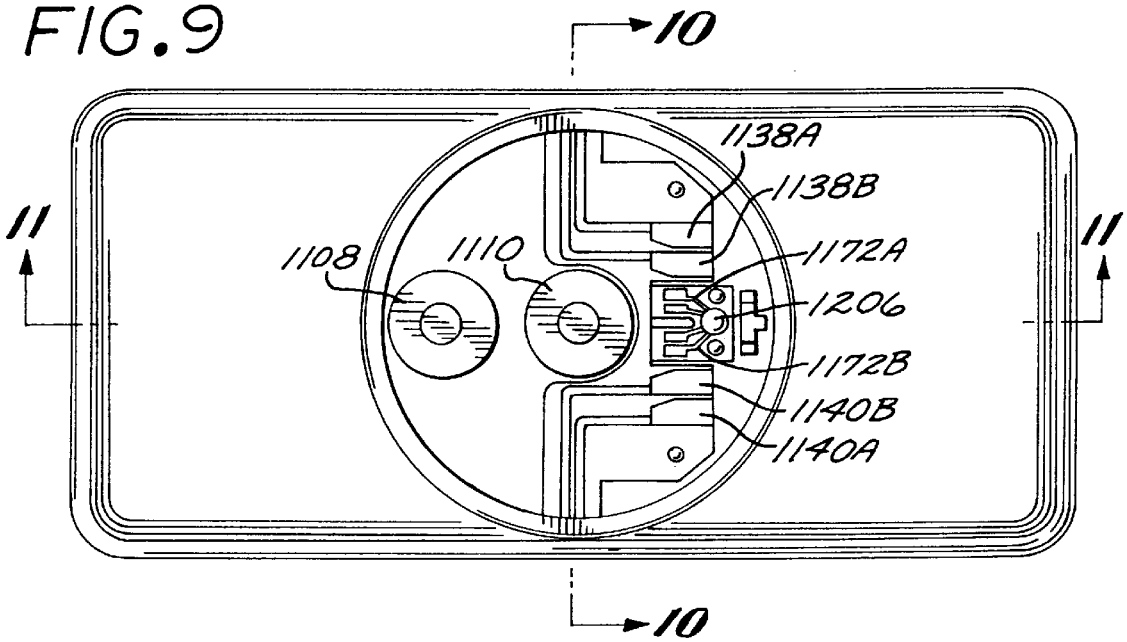
FIG. 9 is a side view of the off-carriage ink container, showing the leading cap.

The coils 1130, 1132 are connected to contact pads 1138, 1140 that are accessible on the outside of the sealed container (FIGS. 6 and 9). Flexible circuit leads 1142, 1144 respectively connect these ink level sensing pads to the coils 1130, 1132; these leads run through a seal zone that separates an outside atmosphere from the pressure chamber. More specifically, each pair of pads 1138A, 1138B and 1140A, 1140B provides an independent pair of connections for each of the two opposing coils. This allows an excitation signal to be applied to one coil, and the corresponding voltage resulting from the electrical coupling to be sensed by the printing system. The voltage sensed by the ILS circuit is readily related to a corresponding ink level, e.g. by values stored in lookup tables in the system memory.

Figure 16A:
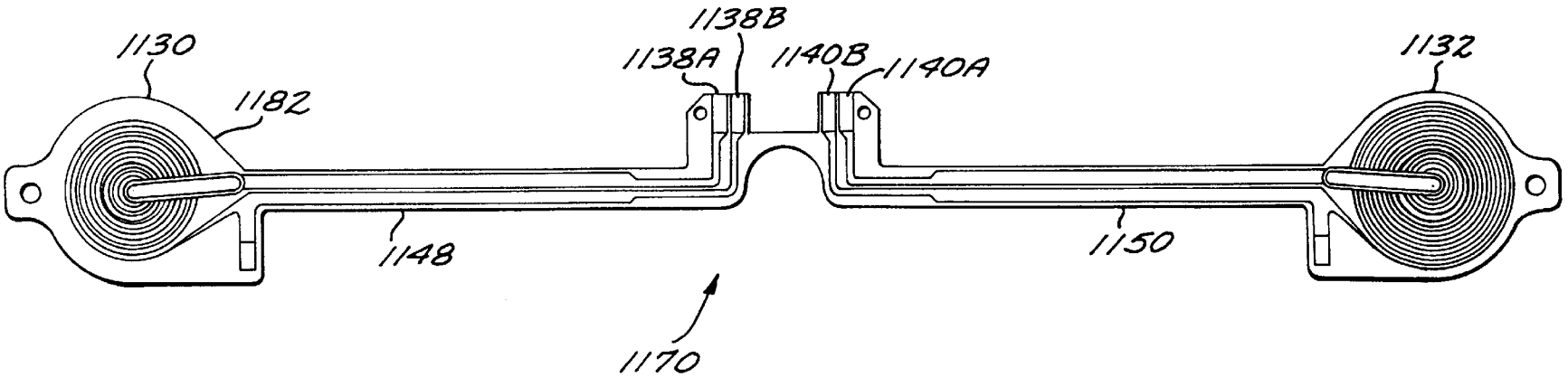
FIG. 16A is a top view of the flexible circuit carrying the ink level sensing circuitry assembled with the ink container.

FIGS. 13 and 16A show the unitary flexible circuit 1170 carrying the ILS leads and ILS coils. Each pair of ILS pads 1138A/B, 1140A/B (on either side of the memory element contacts 1172A, 1172B, when assembled to the chassis) provides contact for one coil. A jumper connects the center of each coil to its one of the leads in order to complete the circuit. This is shown in FIG. 13, wherein coil 1130 has a jumper 1174 connecting from lead 1176 to the coil center terminal 1178. Of course, a layer of insulator 1180 is required to insulate the jumper 1174 from the underlying conductor to prevent shorting the coil. The leads 1176 and 1182 and coil 1130 are formed on a flexible dielectric substrate 1182. A unitary substrate can be used for supporting the coils and leads for both sides of the bag, as shown in FIG. 16A. The leads and substrate can be folded adjacent the right angles to bring the coils into position for attachment to the bag sides. The ILS is described more fully in the above referenced applications, Docket number 10970427, INK CONTAINER WITH AN INDUCTIVE INK LEVEL SENSE, and Docket number 10970428, INK LEVEL ESTIMATION USING DROP COUNT AND INK LEVEL SENSE.

The Chassis Member. An aspect of the invention is a multi-functional chassis member 1120 that enables an ink container having a high degree of functionality while having an efficient assembly process. This part supports the air inlet, fluid outlet, the collapsible ink reservoir, the ink level sensing (ILS) circuitry, ILS trace routing, and provides the surface that seals the pressure vessel from the outside atmosphere.

In an exemplary embodiment, the chassis member 1120 is a unitary element, fabricated of polyethylene by injection molding. The material is chosen to be one which is relatively low cost, chemically inert to the liquid ink, and similar to the layer of the bag material which is heat sealed to the chassis. Another desirable characteristic of the chassis material is that the material is heat stakable at relatively low temperatures. The chassis is injection molded to allow high complexity at a low cost.

As shown in FIG. 10, the pressure vessel 1102 surrounds the collapsible ink reservoir 1112. The reservoir plastic film is folded and heat sealed along edges and sealed to stake or attach surfaces 1122 and 1124 on the chassis 1120, to form the flexible walls 1114 and 1116.

Figure 14:
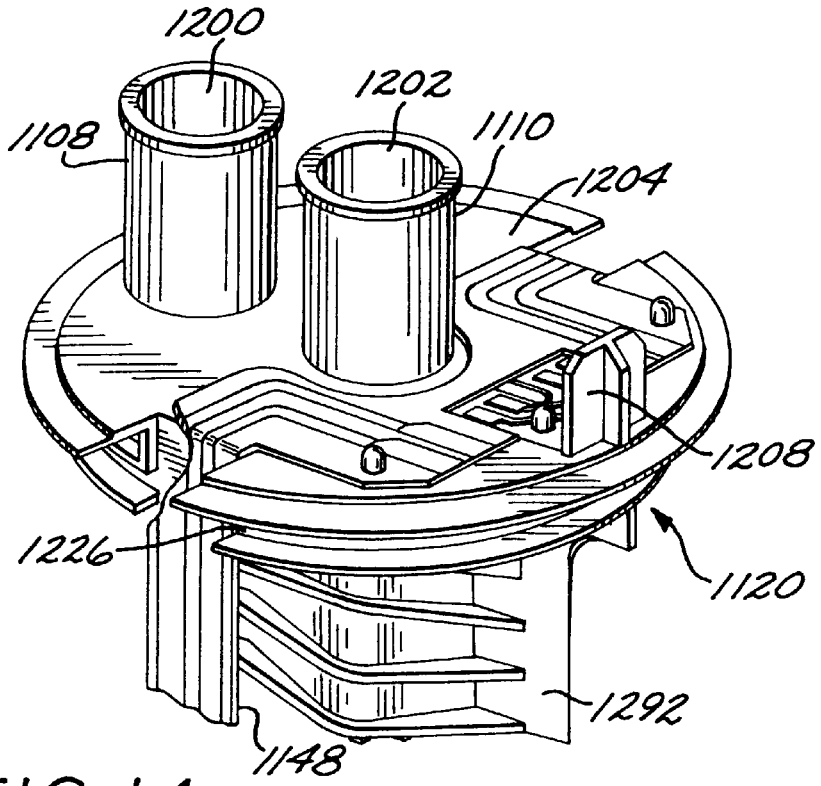
FIG. 14 is an isometric view of the chassis member with the sensor leads in place.

As shown in FIG. 11, the chassis 1120 further provides air inlet and fluid outlet septum towers 1108, 1110, respectively. The air inlet tower 1108 defines a passageway 1200 through the chassis that is in fluid communication with a region of the pressure chamber which is outside the reservoir 1112 (FIGS. 11 and 14). The fluid outlet tower 1110 defines a passageway 1202 through the chassis member that is in fluid communication with the internal collapsible reservoir 1112. The towers extend in a direction generally parallel to the longitudinal axis of the container, in this exemplary embodiment.

Upon installation of the chassis 1120 in the pressure vessel opening, the towers 1108 and 1110 protrude above the opening end of the pressure vessel. With their extension above the surface 1204 of the chassis, and above the neck of the pressure vessel, the towers are accessible for connection with an ink path connection and an air supply connection when the ink container is installed in its bay at the ink supply station of the printing system. The connection of the ink path and air supply is described more fully in the above referenced application, Docket number 10970426, entitled REPLACEABLE INK CONTAINER ADAPTED TO FORM RELIABLE FLUID, AIR AND ELECTRICAL CONNECTION TO A PRINTING SYSTEM.

The chassis 1120 also provides a flat surface 1204 for supporting a memory element chip package 1206 (FIG. 9) and the two pairs of leads connecting to the inductive coils for sensing ink level described in additional detail below. The memory chip has its own small circuit panel with four electrical contacts, and is connected to the system controller when the ink container is installed at the supply station. The circuit for the memory chip is attached to the surface 1204 by pressure sensitive adhesive. The controller can write data into the memory, e.g., to identify the current ink volume remaining. Thus, even if a container is removed from the supply station prior to being emptied of ink, and subsequently placed in use, the printing system controller can ascertain the amount of ink already used from the container. In addition to supporting the memory element, the chassis 1120 provides an upstanding member 1208 (FIG. 14) that engages surfaces on a mating electrical connector (which is located at the ink supply station bay) to provide alignment between both sides of the electrical connection. This connector makes simultaneous face-type connection with all 8 pads, i.e. 4 pads for the memory element and two pairs of pads for the inductive coils.

The chassis member 1120 includes a keel portion 1292, which provides the sealing or attach surfaces 1122, 1124 for connection to the collapsible reservoir (FIG. 11). The bag membranes can be sealed to the sealing surfaces in a variety of ways, e.g. by heat staking, adhesives or ultrasonic welding. In an exemplary embodiment, the bag membranes are attached by heat staking. The lower surface 1294 of the keel has a compound curvature to prevent concentration of stress should the ink container be dropped. Also, protruding tab features 1296 around the inlet to the ink flow path serve to prevent the bag collapse from sealing off the inlet before all ink is remove from the reservoir. Due to the elongation of the keel, the sealing surfaces extend generally parallel, with a small angular offset, relative to the longitudinal axis of the ink container.

The chassis sealing surfaces have protruding ribs extending therefrom to improve the quality of the seal. These ribs, e.g. ribs 1282, 1284, 1286 (FIG. 15) extend generally transverse to the longitudinal axis of the reservoir. The ribs concentrate the heat staker force during the heat staking operation to attach the bag films to improve the heat stake attachment. The spaces between the ribs also provide space for molten chassis material to flow during the heat stake. Multiple ribs are provided to provide redundant attach features and strength.

FIG. 14 shows the chassis prior to attachment of the septa 1214 and 1216. As shown in FIG. 11, septa 1214 and 1216 are secured at the respective ends of the towers 1108 and 1110 by crimp caps 1218, 1220. For the ink outlet, a spring 1222 presses a sealing ball 1224 against the septum 1216. This is because the ink seal is critical; if the septum 1216 takes on a compression set, it is important that the fluid outlet not leak. In contrast, the air inlet can take on a set without an issue, and so in this exemplary embodiment, no additional sealing structure is employed.

Figure 15:
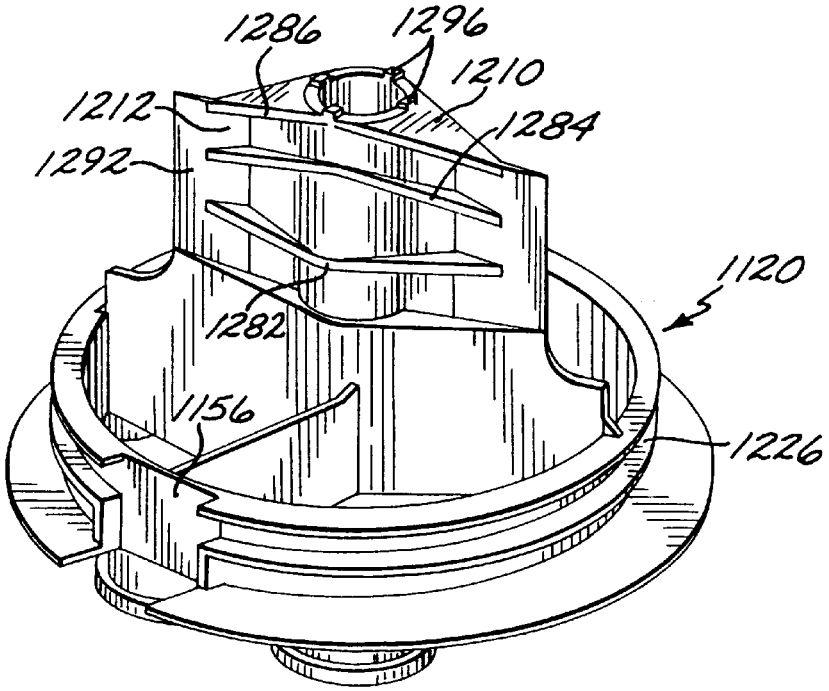
FIG. 15 is an inverted isometric view of the chassis member of FIG. 14.

The routing of ILS leads or traces 1148, 1150 from the contact pads 1138A, 1138B, and 1140B and 1140B toward the ILS coils 1130, 1132 is illustrated in FIGS. 9, 10, 14 and 15. The chassis 1120 supports the flexible circuit portions 1148 and 1150; an o-ring seal 1152 provides a seal between the chassis periphery and the neck 1154 of the bottle-shaped pressure vessel 1104. As shown in FIGS. 10, 14 and 15, respective routing surfaces 1156, 1158 are provided in the chassis 1120 for routing the ILS flexible circuit traces 1148, 1150 between the o-ring 1152 and the chassis. FIG. 10 shows the flat zones 1160, 1162 formed on the interior surface of the neck 1154 of the pressure vessel to match the flat portions of the routing surface 1156, 1158.

There are alternatives to this routing scheme. For example, an adhesive could be used to complete the seal zone through which the leads pass. However, this would require steps of curing adhesive, making this alternative less manufacturable. In addition, adhesives tend to be less robust than a compressed o-ring.

The chassis 1120 defines a circumferential channel 1226 (FIGS. 11, 14, 15) that supports the o-ring 1228 providing a seal between the chassis and the pressure vessel. As described above, the chassis 1120 also provides flexible circuit routing surfaces 1156, 1158 for the flexible circuit 1170 to pass from the flat outside surface 1204 of the chassis, between the o-ring and the flex routing surface, and into the pressure vessel. The pressure vessel has an inside surface whose shape matches an outside surface on the chassis. Portions of the chassis are flat, for routing the flexible circuit traces; the vessel has flat portions or zones 1160, 1162 to match the flat portions of the chassis.

Figure 16B:
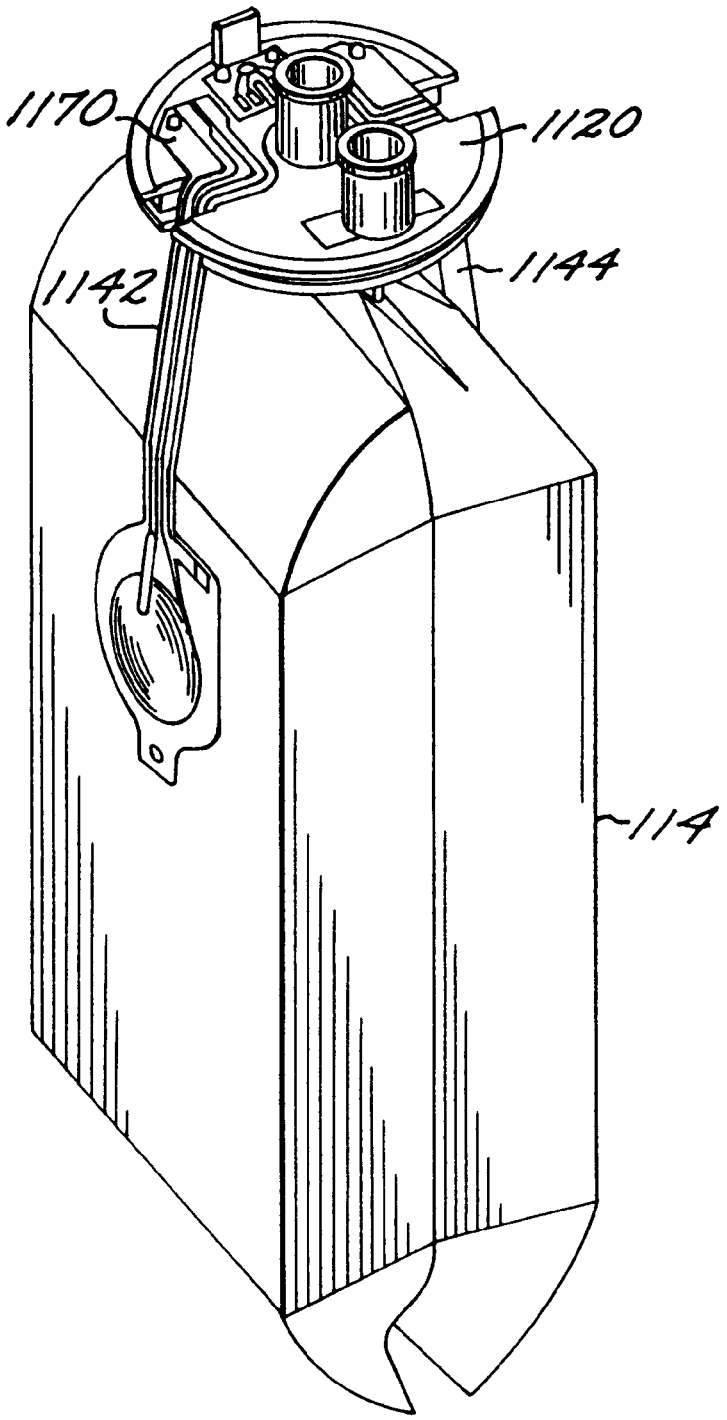
FIG. 16B is an isometric view of the reservoir with the chassis and the flexible circuit.

In an exemplary embodiment, the o-ring material is a relatively stiff material such as EPDM, silicon rubber, or neoprene, having a 70 shore-A hardness. Enhancement of the seal in the area of the ILS lead pathways, i.e. where the o-ring passes over the flexible circuit, is obtained using such a stiff material because it works in combination with a pressure sensitive adhesive used to attach the ILS leads. The firm o-ring material is believed to squeeze the adhesive out around the edges of the ILS leads, and fill small discontinuity cavities adjacent to these edges. The underside of the flexible circuit 1170 has a coating of pressure-sensitive adhesive underlying specific areas of the flexible circuit. Adhesive underlies the coils and areas which will come into contact with the chassis member. The adhesive is thus used to attach the coils to the stiffeners on the reservoir walls, and to attach the ILS flexible circuit to the chassis member 1120. FIG. 16B is an isometric view of the collapsible reservoir 114, attached to the chassis 1120, with the ILS flexible circuit attached to the reservoir and to the chassis.

Once the reservoir bag is attached to the chassis, and the coils 1130, 1132 are attached to the collapsible walls 1114, 1116, the reservoir assembly is inserted into the pressure chamber through the vessel opening. The o-ring provides a seal fit against the interior surface 1162 of the pressure vessel. An aluminum crimp ring 1280 (FIG. 10) is installed to secure the chassis 1120 and reservoir structure in place.

The chassis 1120 is an integrally molded thermoplastic part, providing an o-ring support and sealing surface 1226, routing surfaces 1156, 1158 for ILS traces, two septum towers 1108, 1110 and their respective communicating conduits 1200, 1202, a surface 1204 for supporting electrical interconnection, the upstanding member 1208, and support and sealing surfaces 1210, 1212 for the collapsible bag. By offering so much functionality on one molded part, the overall cost of the containers 110–116 is minimized and additional sealing mechanisms are avoided. Another advantage of an integrally molded chassis is dimensional accuracy. When ink container 110 is installed into a printing system, the electrical, air and fluidic connectors must engage corresponding connectors associated with the printing system at the ink supply station 100. The integrally molded chassis minimizes locational variation of these connectors relative to one another and thus improves the likelihood of providing reliable connections.

The leading end cap. The end cap 1104 provides several functions. These include keying functions for preventing insertion of an ink container of the wrong type, e.g the wrong ink type or color, or ink reservoir size, into a particular supply station bay. The cap also serves aligning functions in ensuring proper alignment of an ink container with the supply station bay structural components. The cap also includes protective structure which protects the ink and air towers of the chassis from physical damage.

In an exemplary embodiment, the leading end cap 1104 is an injection-molded part, fabricated from polypropylene.

Figure 19:
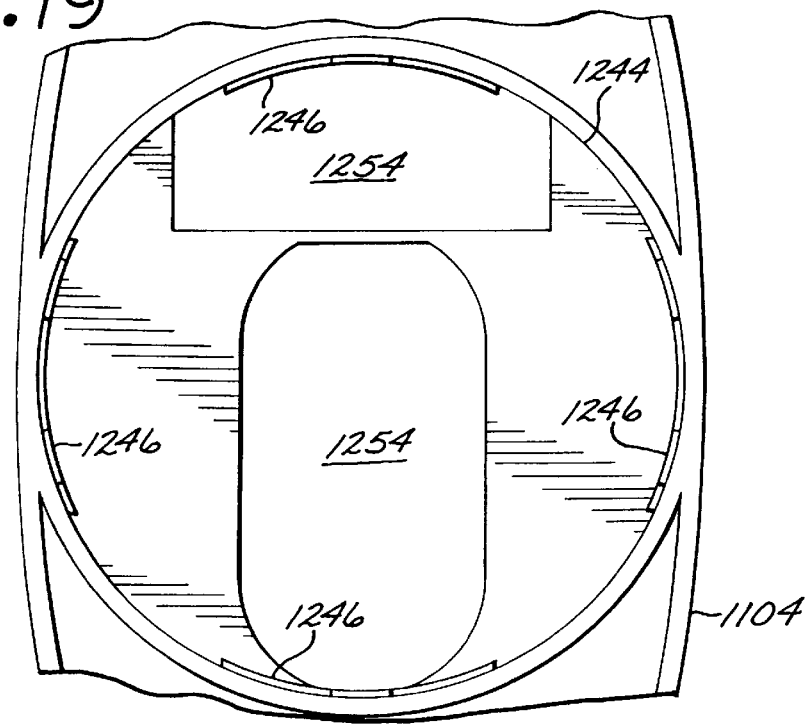
FIG. 19 is a bottom view of the leading cap of the ink reservoir taken from line 19—19 of FIG. 17.
Figure 23:
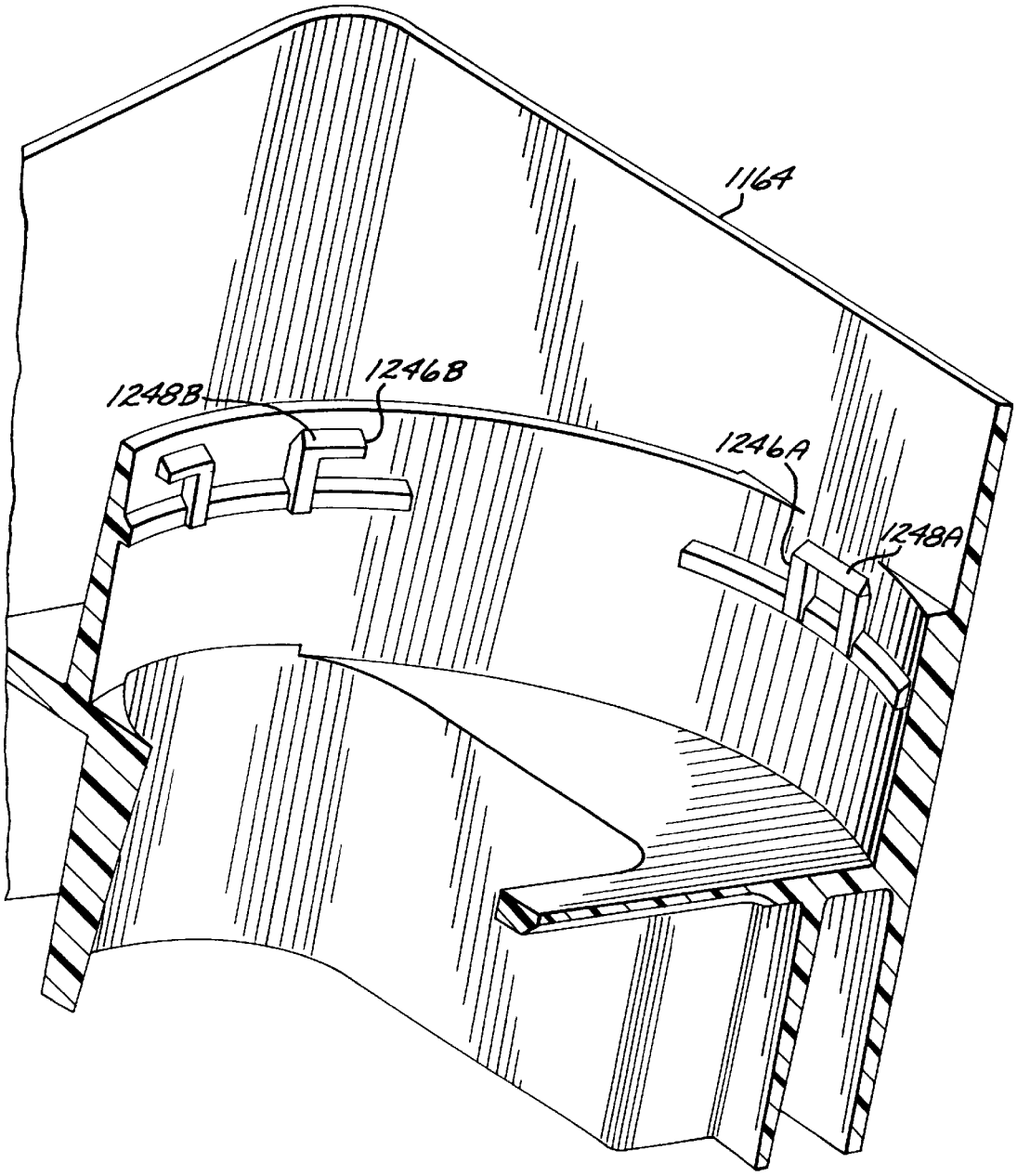
FIG. 23 is an isometric view of a portion of the leading edge cap, showing the locking features.

As shown in FIG. 5A, with additional details in FIGS. 19 and 23, the leading end cap 1104 is secured onto the neck of the pressure vessel by engagement of locking features on the cap and the neck region of the pressure vessel. Thus, the cap 1104 includes a cylindrical engagement structure 1244 (FIGS. 19, 23) with two pairs 1246A, 1246B of inwardly protruding engagement surfaces for engaging corresponding a flange 1252B of the neck of the pressure vessel to secure the cap 1104 into registered position on the pressure vessel.

The surfaces 1246A, 1246B are spaced around the periphery of the engagement structure 1244. Each engagement surface 1246A, 1246B includes a ramp surface 1248A, 1246B for riding over the flange 1252B as the cap is pressed onto the neck of the pressure vessel.

Figure 17:
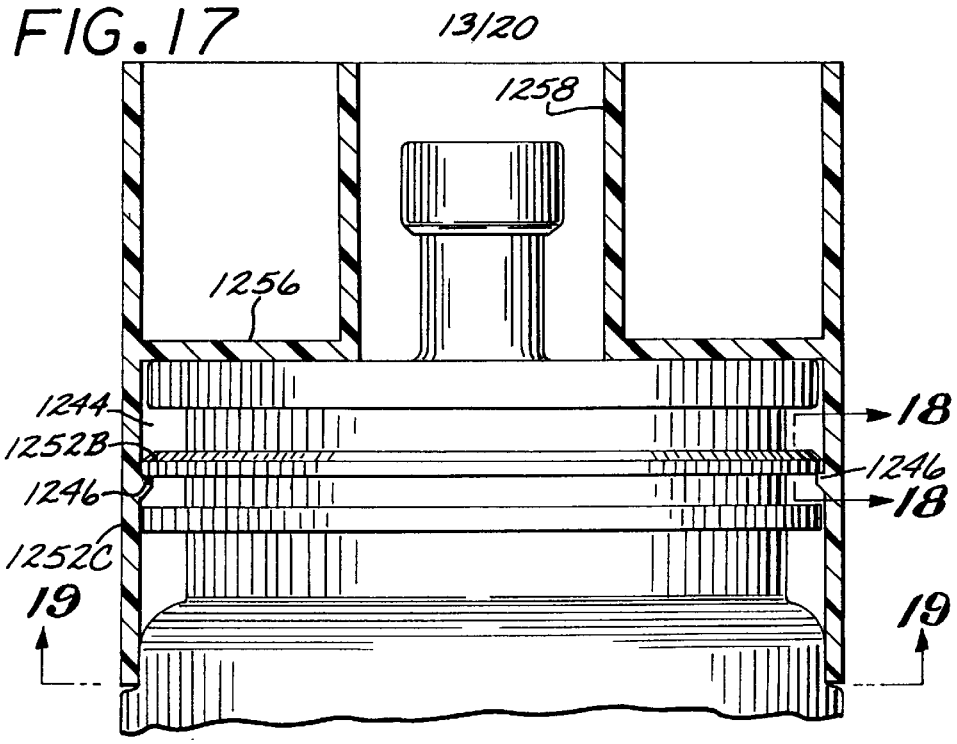
FIG. 17 is a side view of the neck region of the pressure vessel, showing the attached leading end cap in cross-section.
Figure 18:
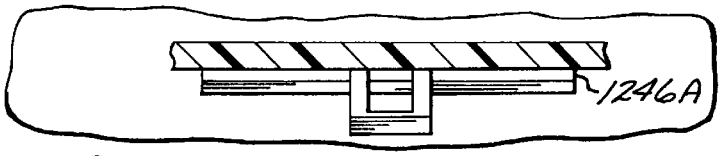
FIG. 18 is a cross-sectional view taken along line 18—18, showing a locking feature for locking the leading cap in position on the pressure vessel.
Figure 28:
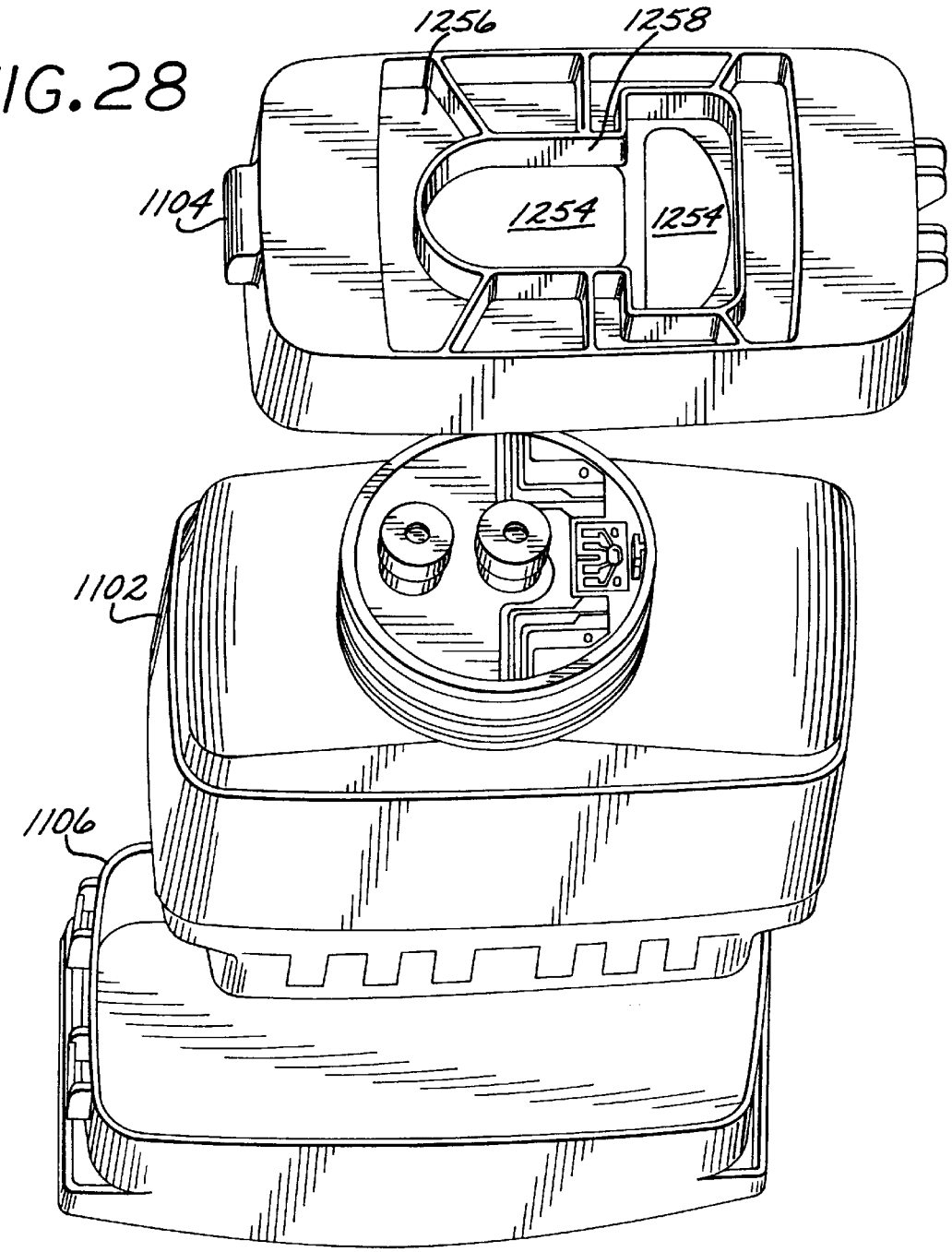
FIG. 28 is an isometric exploded view showing the assembled pressure vessel/reservoir with the leading end and trailing end caps.

As shown in FIG. 28, with additional details shown, e.g. in FIG. 17, the transverse end (in relation to the longitudinal axis of the container) of the cap 1104 further includes a flat surface 1256 into which openings 1254 is formed. Surrounding the opening 1254 is a key-shaped boss or wall structure 1258. The wall structure 1258 provides a protective wall around the towers 1108 and 1110 and electrical interconnect contacts after installation of the cap, thereby protecting these components from physical damage. Moreover, the underside of the flat surface 1256 provides a stop surface against which the rim of the pressure vessel registers as the cap 1104 is pressed on. Once the surfaces 1246 have engaged the vessel rim 1250, the cap is securely locked into position on the pressure vessel, and cannot be removed without breaking the locking features.

Figure 24:
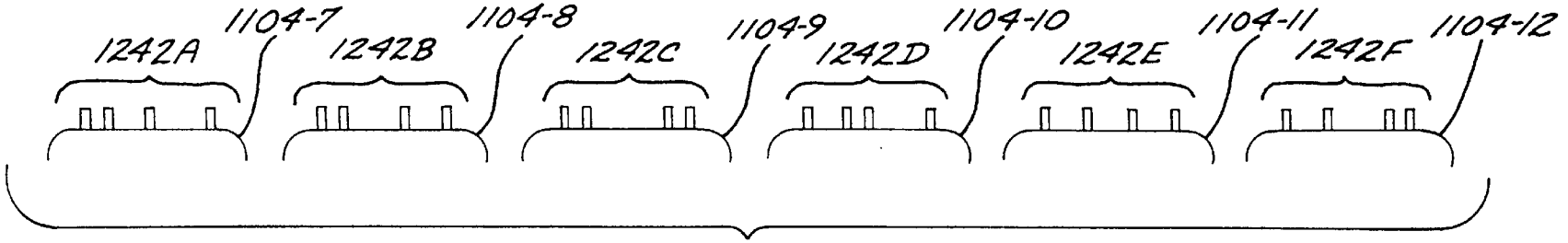
FIG. 24 shows keying features for the leading end cap for different ink colors.

As shown in FIGS. 6 and 28, respective keying and aligning features 1240 and 1242 are provided at opposite sides of the leading cap 1104. These features prevent major ink incompatibilities. By their asymmetry, they prevent backwards insertion (180 degree) installation in the ink supply station relative to a direction of installation. In a preferred embodiment, feature set 1240 is a variable feature for defining the color of the ink disposed in the container reservoir. This is achieved by the geometry of the feature 1240. FIG. 24 illustrates six possible cap/feature configurations. Cap 1104-1 employs color identifying feature 1240A, which specifies the color yellow in this case. Similarly, cap 1104-2 employs feature 1240B (magenta), cap 1104-3 employs feature 1240C (cyan), cap 1104-4 employs feature 1240D (black), cap 1104-5 employs feature 1104-5 (first other color), and cap 1104-6 employs feature 1240F. Each ink supply station bay has provided therein corresponding features which permit only an ink container with the proper color feature set to be docked at the bay. The interaction of the corresponding features on the cap and the supply station bay further provide aligning functions to properly align the cap and container with the bay. This increases the reliability of the ink, pressurized air system and electrical connections made between the ink supply station bay and the ink container.

The second keying features 1242 are also employed to provide keying and identifying functions. The features 1242 comprise a set of thin fins protruding from the side of the cap. The number of fins and spacing between the fins represent a code identifying product type, which can include type of ink, reservoir capacity, and the like. Here again, each ink supply station bay has provided therein corresponding features which permit only an ink container with the proper product type feature set to be fully inserted into a bay for mating connection to the ink system. This will prevent contamination of the system with improper ink types, for example. Also, the features 1242 provide aligning functions, in the same manner as described above with respect to features 1240.

Figure 25:
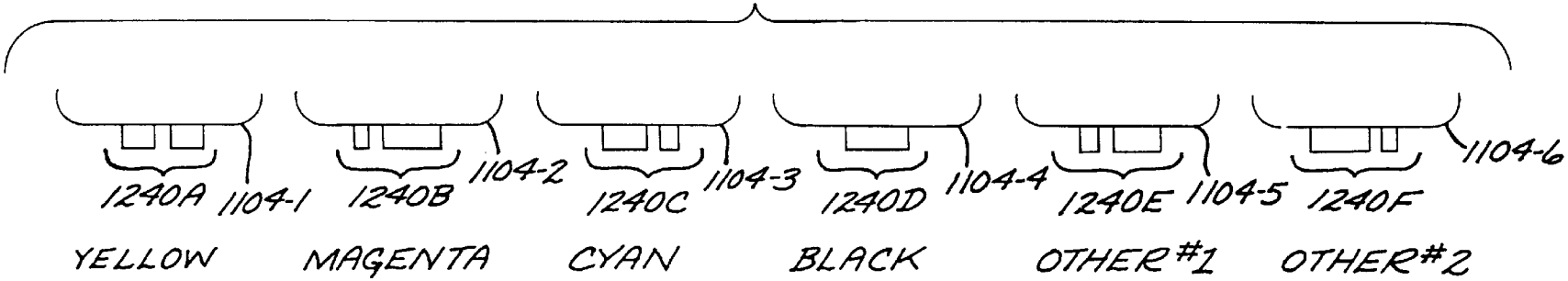
FIG. 25 shows keying features for the leading end cap for different product types.

FIG. 25 represents several different possible configurations of the feature set 1242, showing feature sets 1242A–1242F for different configurations of caps 1104-7 to 1104-12.

As with the feature 1240, the ink supply station bay is provided with keying features which correspond to the feature 1242, preventing insertion of an ink container which does not have the corresponding key feature, preventing docking of an ink container of the wrong product type in a given supply station bay.

It will be appreciated that a set of caps can have identical features 1242, representing a particular product type, while having different features 1240, representing different ink colors for containers of the same product type.

Figure 22:
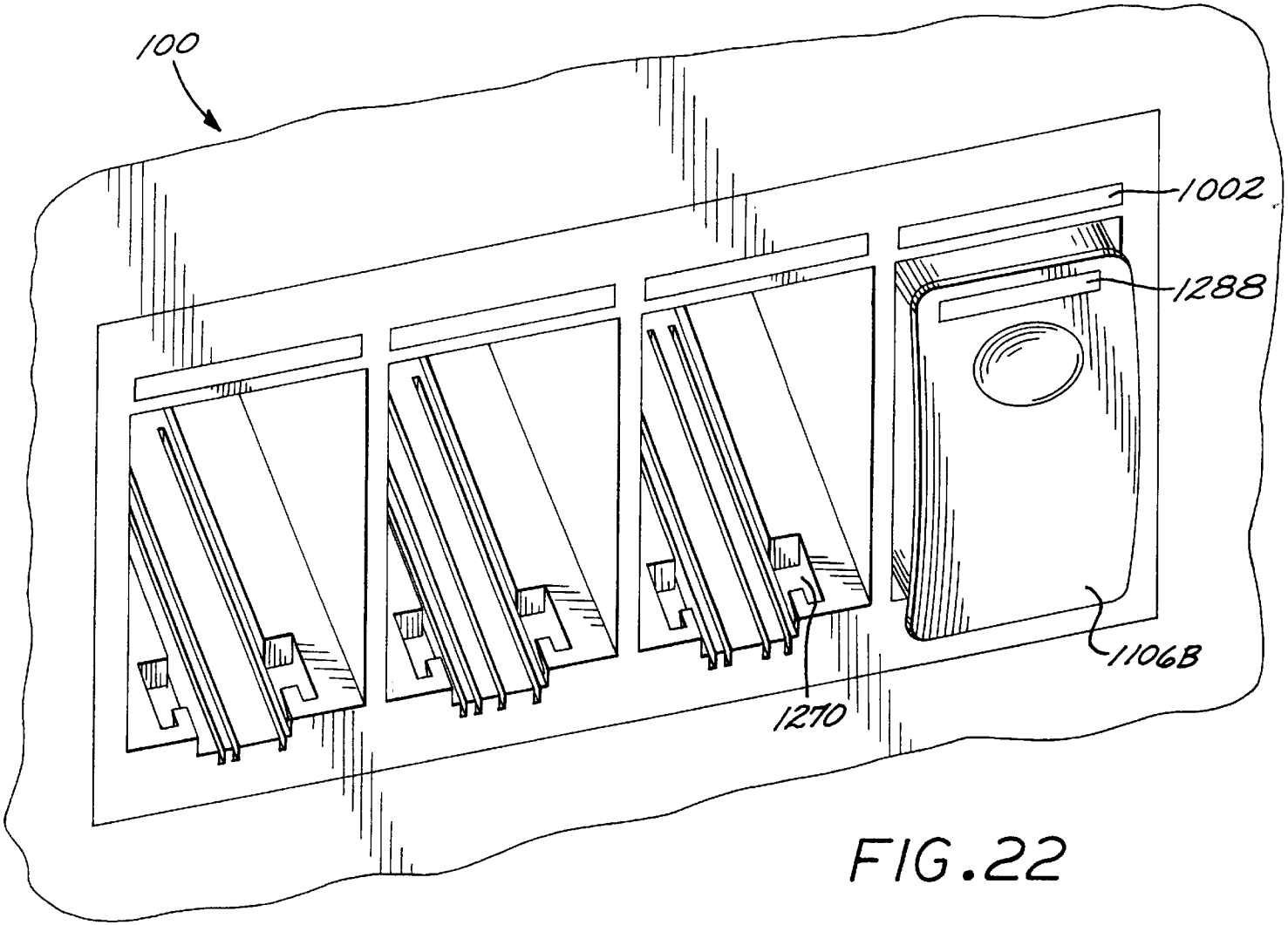
FIG. 22 is an isometric view of the off-carriage docking station for the off-carriage ink reservoirs comprising the printer/plotter system of FIG. 3.

The Trailing End Cap. As shown in FIGS. 8 and 9, the trailing end cap 1106 provides a plurality of mechanical functions. The trailing cap 1106 provides an enlarged head to prevent backward insertion in the ink supply station 100. In addition, the trailing cap provides latch surfaces 1230 and 1232 (FIG. 6) which engage corresponding features at the ink supply station when the container is docked to secure the container in a latched position, as is described more fully in the above referenced co-pending application entitled METHOD AND APPARATUS FOR SECURING AN INK CONTAINER, attorney docket 10970424. These supply station features are generally illustrated in FIG. 22 as features 1270.

Figure 20:
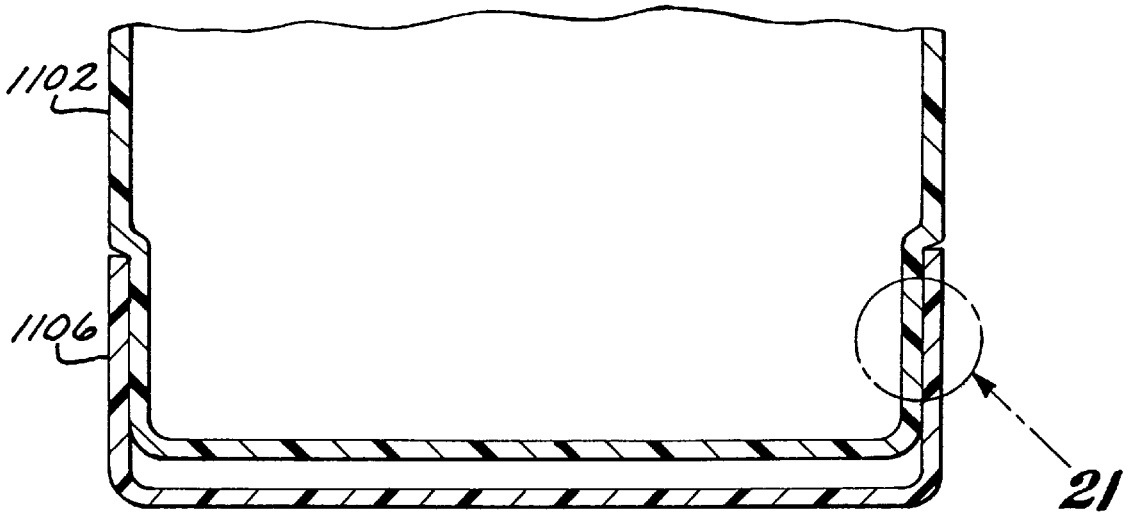
FIG. 20 is a cross-section view showing the trailing end of the pressure vessel with the trailing cap.
Figure 21:
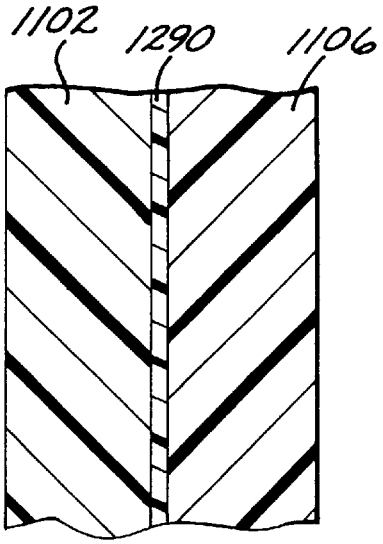
FIG. 21 is an enlarged view of the area indicated as area 21 in FIG. 20, showing the adhesive attachment of the trailing cap to the pressure vessel.

The trailing cap is attached to the pressure vessel in this exemplary embodiment by adhesive. This is illustrated in FIGS. 20 and 21. The trailing end of the pressure vessel is reduced in width dimension, and the cap 1106 is appropriately sized to fit over the reduced size end of the vessel (FIG. 21). The cap 1106 is secured in place by a layer 1290 of adhesive, in this exemplary embodiment.

The trailing cap includes all of the user-viewable surfaces of the container when it is inserted into the ink supply station bay. For this exemplary embodiment, only surface 1106B (FIG. 22) is visible when the container is inserted into the bay. The advantage of this feature is that stringent cosmetic requirements for a consumer product such as the ink container are limited to a single part (i.e. the cap 1106) of limited surface area. Another advantage is that the trailing cap 1106 is added at the end of the assembly process, so that it will not be marred or scratched during preceding steps of the assembly.

Another feature of the trailing end cap is a visible color indicia swatch or element 1288, on the end surface 1106B. This swatch is a visual indication of the color of the ink disposed within the container, and matches a corresponding swatch 1002 disposed on the housing for the supply station bay, as shown in FIG. 22. The swatches 1288 and 1002 can be labels adhesively attached, in one exemplary embodiment. Alternatively the elements 1288, 1002 can be text describing the color.

Assembly of the Ink Container. The ink container can be assembled in a highly efficient manner, as a result of the multiple functions provided by the chassis member. With efficient assembly, the cost can be minimized, and the reliability of the finished product is improved.

Figure 26:
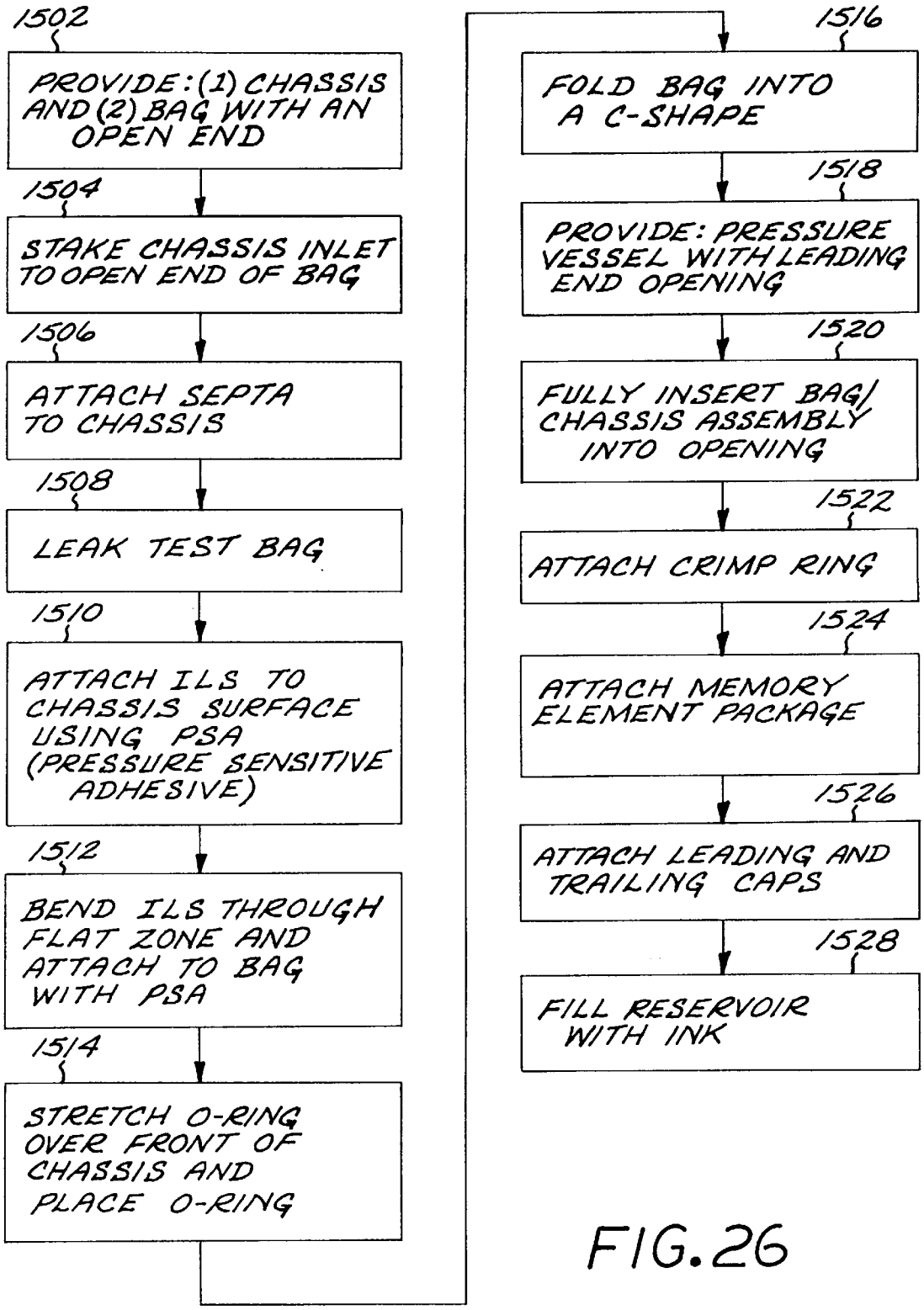
FIG. 26 is an assembly flow diagram illustrating an assembly process for assembling the ink container.

FIG. 26 is a flow chart showing illustrative steps in the assembly of an ink container in accordance with the invention. First, a chassis element 1120 and reservoir bag having an open end are provided (step 1502). The open end of the bag is then sealed to the keel of the chassis member by a heat staking process (step 1504), and the bag/chassis assembly is tested for leaks (step 1508). The ILS flexible circuit is now attached to the flat chassis surface 1204, using the pressure sensitive adhesive applied to the corresponding surface region of the circuit substrate (step 1510). After attachment of the ILS circuit at the surface 1204, the ILS flexible circuit is bent to follow the electrical pathways 1156, 1158 provided by the chassis member 1120, and the coils and stiffeners are attached to the side walls of the bag, again with pressure sensitive adhesive (step 1512).

After the ILS circuit is attached, the o-ring 1152 is stretched over the front of the chassis member, and placed in its channel provided by the chassis member (step 1514).

Figure 27:
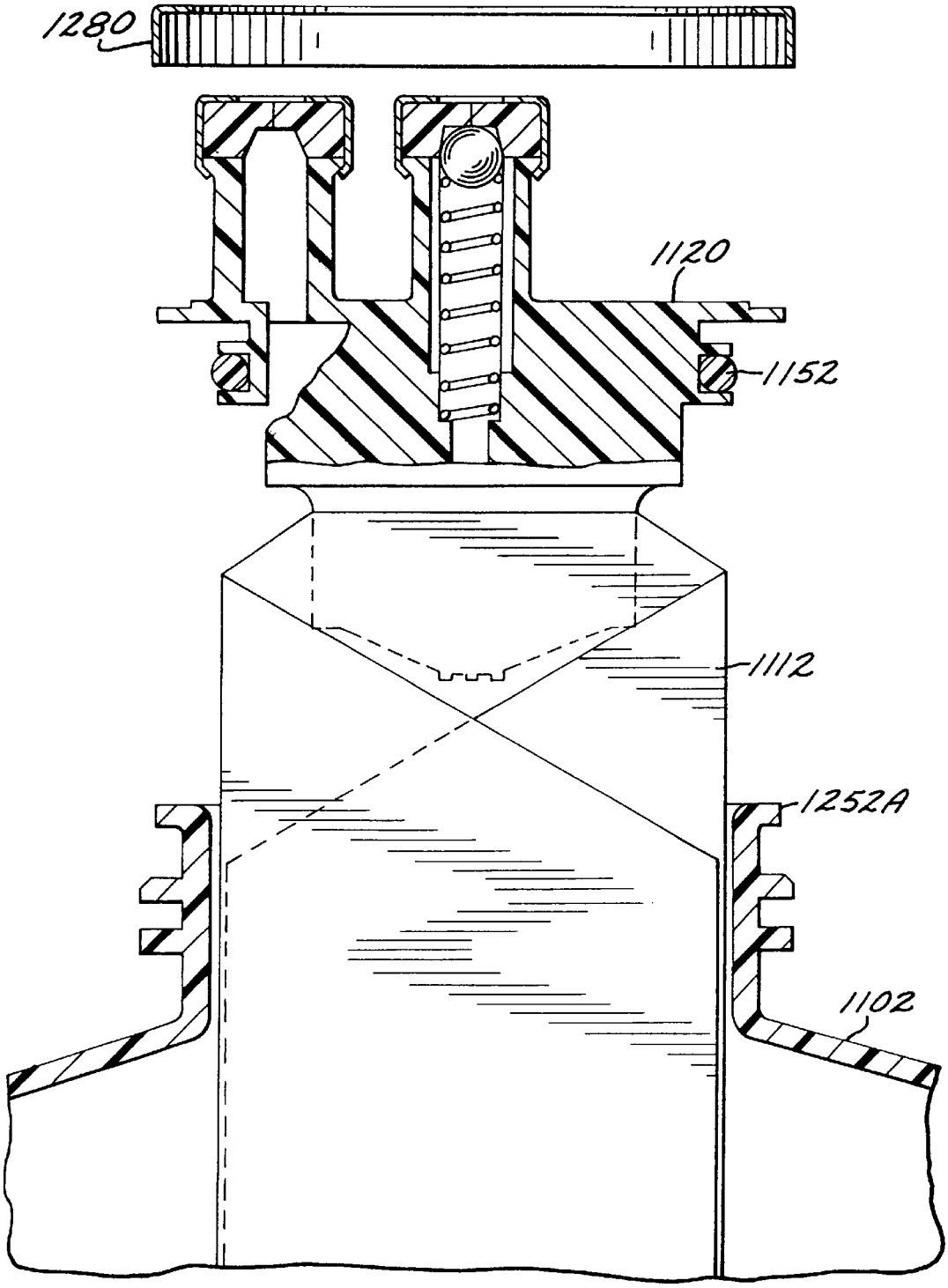
FIG. 27 is a partial side cross-sectional exploded view of the ink container illustrating assembly.

The reservoir bag of the chassis/bag/ILS sub-assembly is now folded into a C-shape to facilitate the insertion of the sub-assembly into a pressure vessel (step 1516). A pressure vessel with a leading end opening is provided (step 1518), and the chassis/bag/ILS sub-assembly is fully inserted into the pressure vessel through the opening (step 1520). FIG. 27 indicates the insertion of the chassis/bag/ILS sub-assembly into the opening of the pressure vessel 1102. After insertion of the sub-assembly into the pressure vessel, an aluminum crimp ring 1280 is installed to secure the chassis in the inserted position (step 1522). The ring is crimped over the top flange 1252A of the vessel. The memory chip package is attached to the chassis (step 1524).

At this point, the ink reservoir is completely assembled within the pressure vessel, and there remains only the tasks of attaching the leading and trailing end caps 1104, 1106. FIG. 28 shows the assembled pressure vessel and ink container, in exploded view with the caps 1104, 1106. The leading and trailing caps are attached to the pressure vessel (step 1526) in the manner described above. The reservoir is filled with ink through the ink tower passageway (step 1528) to complete the assembly process.

An ink container and assembly method have been described which provides many advantages. The ink container supports high ink flow rates, e.g. for large format printing and plotting applications, high speed color copiers, line printer, etc. The risk of a severe ink leak is greatly reduced because the flaccid bag ink reservoir is contained within the air tight pressure vessel. The number of hermetic seals is reduced, due to the multi-function chassis member. The ink level within the container can be sensed through the use of the inductive coils and ink level sensing circuits. Top down assembly of the container is achieved. The reliability of the ink container is very high. Water vapor loss through diffusion from an external environment into the ink reservoir is reduced because the region between the flaccid bag and the pressure vessel becomes humidified. Ink can be withdrawn from the reservoir with the container in any orientation. The containers do not need to have an integral air or ink pump, and so an array of throughput needs can be met by the ink container. Stresses due to pressurization on the flaccid bag are reduced since forces are balanced across the bag area when compared to pressurization systems that press on the bag film, such as spring bag systems. Pressure drops through the system are relatively low. The ink reservoir can be filled with ink through the same ink port used to connect to the system, and so an extra fill port is not needed.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An off-carriage ink container for an inkjet printing system, the printing system including a traversing carriage including at least one printhead, and an ink supply station into which the ink container is removably attached, the ink container comprising:

a pressure vessel having a gas inlet for receiving a pressurized source of gas and a fluid outlet for delivering pressurized ink in response to pressurization, said pressure vessel devoid of container keying physical features; and a first cap attached to an end of said pressure vessel, said first cap fabricated as a separate structure distinct from said pressure vessel, said first cap having a plurality of mechanical features that provide mechanical functions for said ink container, said mechanical functions including a keying function or a latching function.

2. The ink container of claim 1 wherein said end of said pressure vessel is a leading end relative to a direction of insertion of said ink container into said printing system.

3. The ink container of claim 2 wherein said plurality of mechanical features includes a keying feature for engaging a corresponding station key feature at the ink supply station, and said mechanical functions include said keying function.

4. The ink container of claim 2 wherein said plurality of mechanical features include a boss for protecting a leading surface of said ink container and said fluid outlet from physical damage.

5. The ink container of claim 1 wherein said end of said pressure vessel is a trailing end relative to a direction of insertion of said ink container into said printing system.

6. The ink container of claim 5 wherein said first cap includes a color identifying element which is visible when the ink container is attached to the ink supply station, said color identifying element for identifying a color of a liquid ink held within the ink reservoir.

7. The ink container of claim 5 wherein said cap includes all surfaces of the ink container which are visible to a user of the printing system when the ink container is attached to the ink supply station.

8. The ink container of claim 5 wherein said mechanical features include at least one latch feature for latching the ink container in said supply station.

9. The ink container of claim 5 wherein said mechanical features include an oversized handle that prevents backwards insertion of the ink container into the ink supply station.

10. The ink container of claim 1 wherein said end cap has engagement features adapted to allow said end cap to be snap fitted onto said pressure vessel.

11. The ink container of claim 1 wherein said end cap is fabricated using an injection molding process.

12. The ink container of claim 1 wherein said pressure vessel is devoid of latching physical features.

13. An off-carriage ink container for an inkjet printing system, the printing system including a traversing carriage including at least one printhead, and an ink supply station into which the ink container is removably attached, the ink container comprising:

an ink container housing, the housing including an ink reservoir and a fluid outlet in fluid communication with said reservoir, said fluid outlet for providing ink to said printhead;

a first cap attached to a leading end of said housing, said first cap fabricated as a separate structure distinct from said housing, said first cap having a plurality of mechanical features that provide mechanical functions for said ink container;

a second cap attached to a trailing end of said housing, said second cap fabricated as a separate structure distinct from the housing.

14. An ink container for an inkjet printing system including an ink supply station, the container removably connectable to a supply station bay to supply ink to the printing system from an ink reservoir, the ink container comprising:

a pressure vessel for defining an interior pressure chamber, said vessel having a opening defamed therein;

a collapsible ink reservoir for holding a supply of liquid ink, said reservoir disposed within said pressure chamber;

apparatus for providing an ink path from outside said pressure vessel to said ink reservoir, said apparatus providing an ink tower protruding from the opening for connection at the supply station to the printing system; and a leading end cap secured to a leading end of said vessel, said cap including a protective wall structure protruding from a leading surface of said apparatus and surrounding the ink tower for protecting the ink tower from physical damage while permitting access to the tower for connection at the ink supply station.

15. The ink container of claim 14 further including a trailing end cap secured to a trailing end of the vessel, said trailing end cap providing latching features for engagement with corresponding bay latching features when the ink container is inserted into the bay.

16. The ink container of claim 14 wherein said leading end cap further includes a first key feature indicative of a product type and a second key feature indicative of a color of ink contained within the reservoir.

17. The ink container of claim 14 wherein the pressure vessel includes a neck defining said opening, and wherein the leading end cap includes a circumferential surface for surrounding the neck and having extending therefrom a plurality of locking features for engaging a corresponding plurality of matching engagement features on an external surface of the pressure vessel.

18. The ink container of claim 14 wherein said wall structure is spaced from the ink tower to provide access space for engagement of the ink tower with a corresponding supply station fitting.

19. The ink container of claim 18 further including an electrical circuit for sensing an amount of ink in the reservoir, the circuit including a set of leads connected to electrical contacts provided adjacent the ink tower, and wherein the wall structure permits access to the electrical contacts by interconnection circuitry comprising the ink supply station while protecting the ink tower.

20. An ink container for an inkjet printing system including an ink supply station, the container removably connectable to a supply station bay to supply ink to the printing system from an ink reservoir, the ink container comprising:

a pressure vessel for defining an interior pressure chamber, said vessel having a leading vessel end and a trailing vessel end;

a collapsible ink reservoir for holding a supply of liquid ink, said reservoir disposed within said pressure chamber;

a leading end cap secured to said leading end of said vessel; and a trailing end cap secured to said trailing end of the vessel.

21. The ink container of claim 20 wherein the pressure vessel includes a neck opening defined by a circumferential neck surface, and the leading end cap includes a circumferential surface for surrounding the neck surface and having extending therefrom a plurality of locking features for engaging a corresponding plurality of matching engagement features on the neck surface of the pressure vessel.

22. The ink container of claim 20 further comprising apparatus for providing an ink path from the exterior of the pressure vessel to said ink reservoir, said apparatus providing an ink tower protruding from the pressure vessel for connection at the supply station to the printing system.

23. The ink container of claim 22 wherein said leading end cap includes a protective wall structure surrounding the ink tower for protecting the ink tower from physical damage while permitting access to the tower for connection at the ink supply station.

24. The ink container of claim 23 wherein said wall structure is spaced from the ink tower to provide access space for engagement of the ink tower with a corresponding supply station fitting.

25. The ink container of claim 23 further including an electrical circuit for sensing an amount of ink in the reservoir, the circuit including set of leads connected to electrical contacts provided adjacent the ink tower, and wherein the wall structure permits access to the electrical contacts by interconnection circuitry comprising the ink supply station while protecting the ink tower.

26. The ink container of claim 20 wherein said trailing end cap provides latching features for engagement with corresponding bay latching features when the ink container is inserted into the bay.

27. The ink container of claim 20 wherein said leading end cap includes a first key feature indicative of a product type and a second feature indicative of a color of ink contained within the reservoir.

28. A method of assembling an ink container to be installed in an inkjet printing system, said inkjet printing system having a printhead for ejecting ink on media, comprising the steps of:

(a) providing a pressure vessel having a gas inlet for receiving a pressurized source of gas and a fluid outlet for delivering pressurized ink in response to pressurization, said pressure vessel devoid of container keying physical features; and (b) attaching a mechanical cap to an end of said pressure vessel, said cap having a plurality of mechanical features that provide mechanical functions for said ink container, said mechanical functions including a keying function or a latching function.

29. The method of claim 28 wherein said end of said pressure vessel is a leading end relative to a direction of insertion of said ink container into said printing system.

30. The method of claim 29 wherein said plurality of mechanical features of the cap includes a keying feature for engaging a corresponding station key feature at the ink supply station, and said mechanical functions include a keying function.

31. The method of claim 29 wherein said plurality of mechanical features of said cap includes a boss protruding from a leading surface of the cap and formed integrally with the cap, said boss surrounding said fluid outlet for protecting a leading surface of said ink container and said fluid outlet from physical damage.

32. The method of claim 29 wherein said end of said pressure vessel is a trailing end relative to a direction of insertion of said ink container into said printing system.

33. The method of claim 32 wherein said mechanical features include at least one latch feature for latching the ink container in said supply station.

34. The method of claim 28 wherein said mechanical functions include positioning said ink container relative to said supply station.

35. The method of claim 28 further comprising the step of attaching a second cap to a trailing end of said pressure vessel, and wherein said step of attaching said first cap attaches the first cap to a leading end of said pressure vessel.

36. The method of claim 28 wherein said end cap has engagement features adapted to allow said end cap to be snap fitted onto said pressure vessel.

37. A method for assembling an ink container to be installed in an inkjet printing system, the method comprising a sequence of the following steps:

providing a pressure vessel having an opening at a leading end of the pressure vessel, the vessel enclosing an ink reservoir holding a supply of ink, the pressure vessel having an ink tower extending from an external surface, and an ink path extending between the ink reservoir and the ink tower; and attaching a leading end cap to the leading end of the pressure vessel, the leading end cap including a protective wall structure surrounding the ink tower while permitting interconnection access to the ink tower while the ink container is installed in the inkjet printing system.

38. The method of claim 37 further including the step of attaching a trailing end cap to a trailing end of the pressure vessel.

39. An off-carriage ink container for an inkjet printing system, the printing system including a traversing carriage including at least one printhead, and an ink supply station into which the ink container is removably attached, the ink container comprising:

an ink container housing, the housing including an ink reservoir and a fluid outlet in fluid communication with said reservoir, said fluid outlet for providing ink to said printhead; and a first cap attached to an end of said housing, said first cap fabricated as a distinct structure separate from said housing, said first cap having a plurality of mechanical features that provide mechanical functions for said ink container, wherein said end of said housing is a leading end relative to a direction of insertion of said ink container into said printing system, wherein said plurality of mechanical features include a protruding boss protruding from a leading surface of the cap and formed integrally with the cap, said boss surrounding said fluid outlet for protecting a leading surface of said ink container and said fluid outlet from physical damage.

* * * * *